US007541533B2

(12) United States Patent
Matsuoka

(10) Patent No.: US 7,541,533 B2
(45) Date of Patent: Jun. 2, 2009

(54) APPARATUS HAVING PAGE TURNING CAPABILITY FOR READING ASSISTANCE

(75) Inventor: Norimichi Matsuoka, Fukuaka (JP)

(73) Assignee: Fujimiyaseisakusho Co., Ltd., Kumamoto (JP)

( * ) Notice: Subject to any disclaimer, the term of this patent is extended or adjusted under 35 U.S.C. 154(b) by 649 days.

(21) Appl. No.: 11/106,622

(22) Filed: Apr. 15, 2005

(65) Prior Publication Data

US 2005/0189465 A1 Sep. 1, 2005

Related U.S. Application Data

(63) Continuation of application No. PCT/JP02/10862, filed on Oct. 18, 2002.

(51) Int. Cl.
*G10G 7/00* (2006.01)

(52) U.S. Cl. ..... 84/489; 84/486; 84/502; 84/503; 84/512; 84/515; 84/517; 84/518

(58) Field of Classification Search ..... 84/486, 84/502, 503, 512, 515, 517, 518; 358/498
See application file for complete search history.

(56) References Cited

U.S. PATENT DOCUMENTS

| | | | | |
|---|---|---|---|---|
| 642,565 | A * | 1/1900 | Rogers | 248/446 |
| 2,755,580 | A * | 7/1956 | Justice | 40/531 |
| 3,939,587 | A * | 2/1976 | Weststrom | 40/531 |
| 4,040,195 | A * | 8/1977 | Claypool et al. | 40/341 |
| 4,121,361 | A * | 10/1978 | D'Arcy | 40/470 |
| 4,463,651 | A * | 8/1984 | Hammer | 84/504 |
| 4,644,675 | A * | 2/1987 | Berger et al. | 40/531 |
| 4,685,374 | A * | 8/1987 | Goldner | 84/487 |
| 4,719,712 | A * | 1/1988 | Moreau et al. | 40/475 |
| 5,493,943 | A * | 2/1996 | Horikawa | 84/519 |
| 6,049,033 | A * | 4/2000 | Dallas | 84/486 |
| 6,574,014 | B2 * | 6/2003 | Mandel et al. | 358/474 |
| 7,019,203 | B2 * | 3/2006 | Wolberg et al. | 84/486 |

(Continued)

FOREIGN PATENT DOCUMENTS

CN 2091768 U 1/1992

(Continued)

*Primary Examiner*—Jeffrey Donels
*Assistant Examiner*—Robert W Horn
(74) *Attorney, Agent, or Firm*—Clark and Brody

(57) ABSTRACT

The inventive apparatus having page turning capability for reading assistance enables to easily turn over pages of a book by a simple operation and provides a more comfortable environment for the person who spends time on reading.

To properly use an apparatus (50), set an open book on a supporting means (1), press the midsection over the right and left pages by a page-pressing means (2), and then press the edges of the right and left pages by page-turning-up means (3, 4). To turn over the page, activate an interlocking means by using a remote handling means, move either one of the right and left page-turning-up means (3, 4), and press the page surface to create a shearing force between the first and second pages so that the page can be turned up. After that, a page-turning-over means (5) starts moving and slips into the back of the page. The page-turning-over means (5) presses the page from behind and turns over the page to the other side. At the same time, the page-pressing means (3, 4) run off the first page already turned up.

14 Claims, 14 Drawing Sheets

U.S. PATENT DOCUMENTS

| | | | | |
|---|---|---|---|---|
| 7,238,872 | B1 * | 7/2007 | Edwards et al. | 84/486 |
| 2003/0172795 | A1 * | 9/2003 | Belkhir | 84/486 |
| 2005/0230592 | A1 * | 10/2005 | Tillinghast et al. | 248/441.1 |
| 2006/0196344 | A1 * | 9/2006 | Wood | 84/486 |
| 2007/0158524 | A1 * | 7/2007 | Banks | 248/458 |
| 2007/0285742 | A1 * | 12/2007 | Wolberg et al. | 358/498 |
| 2008/0316551 | A1 * | 12/2008 | Taylor et al. | 358/498 |

FOREIGN PATENT DOCUMENTS

| | | | |
|---|---|---|---|
| JP | 63-47197 | A | 2/1988 |
| JP | 8-10054 | A | 1/1996 |

* cited by examiner

APPARATUS HAVING PAGE TURNING CAPABILITY FOR READING ASSISTANCE

CROSS-REFERENCE TO RELATED APPLICATIONS

This application is a continuation of International Patent Application No. PCT/JP2002/010862, filed Oct. 18, 2002. This PCT application was not in English as published under PCT Article 21(2).

FIELD OF INVENTION

This invention relates to an apparatus for reading assistance, more precisely, an apparatus having page turning capability for reading assistance such as reading easel, book stand or the like which can also be used by a person in bed or chair.

BACKGROUND OF THE INVENTION

In general, when reading a book, two pages are spread in hands and each page is turned over with fingers. When reading a book for a long time, the hands holding the book may become tired.

Although various apparatuses incorporating page turning capability are known in Japanese published unexamined application Nos. H2-63410, H7-17159, H-10-137045 or other publications, in those conventional apparatuses it may be difficult to turn pages correctly one by one, and such page turning function may be complicated.

Therefore, it is an object of the invention to provide an apparatus which enables to turn pages correctly in easy manners and provides a comfortable environment to people who spend time on reading.

SUMMARY OF THE INVENTION (1) To solve the aforementioned problems, the apparatus having page turning capability for reading assistance in this invention is characterized by comprising a supporting means to support a two page spread book, a page pressing means to hold the midsection over the right and left pages of the book, a page-turning-up means to turn up a page by creating shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means.

For the use of the apparatus in this invention, set a book to be two-page spread on the supporting means, hold the midsection over the right and left pages of the book with the page pressing means, and then hold the edges of the right and left pages with the page-turning-up means.

To properly turn over the page of the book, operate the interlocking means by the remote handling means so that one of the right and left page-turning-up means starts moving in the specified direction pressing the page surface beneath. Then, the shearing force acts between the first and second pages so that only one page is turned up.

When the page is turned up, the page-turning-over means starts moving into the back of the page. The page-turning-over means presses the back of the page and turn over the page to the other side. At the same time, the page pressing means and page-turning-up means run off the first page. And after completing the page turning, the page-pressing, page-turning-up, and page-turning-over means return again to each original position.

Thus, the interlocking system of the page pressing, page-turning-up and page-turning-over means is smoothly activated at the specified time so that each page of the book can be properly turned over.

(2) The aforementioned page-pressing means is preferably provided to hold at least one margin of the upper end and lower end of the midsection of the two-page spread book. Or two sets of page-pressing means are preferably provided on both upper and lower ends of the midsection of the two-page spread book.

(3) The aforementioned page-turning-up means is provided on the margin of both side edges of the right and left pages or upper end or lower end of the right and left pages, each one is symmetrically provided on the margin of the two-page spread book, or preferably provided symmetrically on four corners of the two-page spread book.

Viscoelastic material such as urethane or the like is preferably used on the contact portion between the page-turning-up means and page surface so that an appropriate frictional force can be obtained, which easily turns up the page.

Pressing force to the page surface provided by the page-turning-up means can be adjusted according to the method of the page page-turning-up, positioning or the like. The page-turning-up force can also be increased or reduced according to the distance the page-turning-up means moves. For instance, the page pressing force can be gradually increased when the moving distance is longer, and then, the page pressing force can be reduced.

(4) The aforementioned page-turning-over means is preferably provided on the upper or lower end of the two-page spread book at a certain distance. If the page-turning-over means is provided on the midsection over the right and left pages, the page can be smoothly turned over to right or left.

Each shape of the aforementioned page pressing, page-turning-up and page-turning-over means include but not limited to plate type, bar type, ball type, roller type or others.

(5) The interlocking means can be a device to activate the page pressing, page-turning-up and page-turning-over means together at the specified time as follows.

As a first configuration 1, the interlocking means comprises a core material to be activated by remote handling means, in which locking part to activate each of the page-pressing, page-turning-up, and page-turning-over means is provided. When pushing or pulling the core material, each locking part contacts the page-pressing, page-turning-up and page-turning-over means, and moves them into the specified direction by the specified distance. These locking portions are set on the specified position so that the page-pressing, page-turning-up and page-turning-over means can be activated together at the specified time.

As a second configuration, the interlocking means comprises a slide material to be activated by a remote handling means, in which locking part to activate each of the page-pressing, page-turning-up, and page-turning-over means is provided. When the slide material slidably moves, each locking part contacts the page pressing, page-turning-up and page-turning-over means, and moves them into the specified direction by the specified distance. Each locking part is provided on the specified position so that the page pressing, page-turning-up and page-turning-over means can be activated together at the specified time.

Also, if a return locking part is provided for the core material or slide material, the page pressing, page-turning-up and page-turning-over means will be able to be returned to the original positions after completion of the movement.

(6) The aforementioned remote handling means preferably comprises a function to give cross-directional driving force to the interlocking means. Especially, a pushing and pulling cable provided inside an inner cable is preferably used, wherein the inner cable can slidably move inside an outer tube. The pushing and pulling cable can activate the inner cable and move the interlocking means by the specified distance.

Thus, the pushing and pulling cable can provide the driving force to the interlocking means so that the person who is reading does not need to touch the book or the interlocking means. Even if the distance between the person and the apparatus changes, the interlocking means will always be able to move by the specified distance. Therefore, the page of the book does not easily swing, and the person can read the book comfortably and the apparatus can be downsized.

For other forms of the pushing and pulling cable, it can be suggested that air or liquid is injected into the outer tube so that the pressure transmission of such injected air or liquid activates the interlocking means. Or, the pushing cable and pulling cable can be separately provided.

Furthermore, as the aforementioned remote handling means, servo motor with wired or unwired transmission system can be used.

(7) The apparatus in this invention is characterized in that the page-turning-up means provides shearing force toward the midsection between the right and left pages in a direction from right to left or from left to right to turn up the page.

If the page of the book is unevenly turned up, the page cannot be completely turned over by the page-turning-over means.

In this invention, the shearing force is provided from right or left toward the midsection of the right and left pages, and the page surface is gently bent into an arch, and a clearance is created between the first page and second page. And then the page-turning-over means is inserted into the clearance so that each page can be completely turned over.

(8) Also, the apparatus in this invention is characterized in that the page-turning-up means provides the shearing force vertically toward the upper end or lower end of the right page or left page so that the page surface is turned up.

If the page is bent into an arch to be easily turned up, and the width of the arch is not large enough, the page-turning-over means cannot easily slip into the back of the page. In other words, such arch-shaped page may hinder the page-turning-over means from slipping into the back of the page. Also, if the pages are turned up in the same position all the time, the arch-shaped deflection will be easily created on the page surfaces, which hinders each page from being completely turned over.

In this invention, when the shearing force is vertically provided from the upper end or lower end of the page surface, the page is twisted and turned up. And an open space is created between the first and second page of the book. Then, the page-turning-over means can be easily and completely slipped into the back of the page surface. Thus, the deflection will not be easily created on the page surface, and even if the pages repeatedly turned up, each page will be completely turned over.

In the page-turning-up means, the shearing force can also be provided on the page surface in the combination of vertical and horizontal directions. For example, the shearing force can be properly provided on the page surface in order that the page-turning-up means is vertically moved toward the upper or lower end of the page surface and then the page-turning-up means is horizontally moved to the midsection over the right and left pages.

(9) The apparatus in this invention is characterized in that the aforementioned page pressing means and page-turning-over means rotatably move together.

If the page pressing means keeps pressing the midsection of the pages, the page-pressing means will be an obstacle for the page-turning-over means to turn over the page. To prevent this, the page-pressing means should once run off the page surface. If the page-turning-over means and page-pressing means are separately operated, the interlocking means will be mechanically complicated, and the size of the apparatus becomes larger and more complicated.

In this invention, while the page-turning-over means is moving, the page-pressing means once runs off the page surface. On the other hand, while the page-turning-over means is out of operation, the page pressing means holds the page surface. In the light of this difference, it is suggested in this invention that the page-pressing means and page-turning-over means should move together. In other words, if the page-pressing means begins to move in a condition that the page surface is being pressed by the page-pressing means and the page pressing means will run off the page surface, the page-turning-over means will slip into the back of the page surface. After the page-turning-over means has turned over the page to the other side, the page-turning-over means return again to the initial position. And at the same time, the page pressing means moves back to the initial position and holds and presses a next page. Thus, the page pressing means and page-turning-over means are formed as one unit to move together so that the interlocking means can be simplified.

(10) The apparatus in this invention is characterized in that a page-pressing portion (page-pressing surface) to press the second page surface, after the first page has been turned over, is provided on the aforementioned page-turning-over means.

In turning over the page of the book, if the subsequent pages rise up, turning operation will be unstable. Therefore, it is important to keep pressing the subsequent pages until the next page is turned over. However, it is difficult to turn over the page only by the page-turning-over means. Then, in this invention the page-pressing portion (page pressing surface) is provided on the page-turning-over means, which can hold and press the second page following the motion that the first page is turned over.

Especially, if the aforementioned page-pressing portion (page pressing surface) is provided on the page-turning-over means of the apparatus comprising the page-pressing and page-turning-over means which move together, the page will be always pressed in the page-turning process, thus the book will be firmly supported and each page will be easily turned over.

(11) The apparatus in this invention is characterized by comprising a supplementary page-pressing means to alternately press and turn the page downward interlocking with the page-turning motion by the aforementioned page-turning-over means.

In reading, even if the page surface is pressed by the page-pressing and turning-up means, the page may be waved, which will make it difficult to keep the book open. Also, if the person lying down reads the book, the book will drop down from the apparatus since the weight of the papers is imposed upon the page pressing means and page-turning-up means. Thus, it is uneasy to read the book and the page turning motion is unstable. To solve this problem, another separate component can be provided to hold the page surface. However, such separate component will still hinder the page-turning-over function.

In this invention, to alternately press and turn the page, a supplementary page-pressing means is provided so that the page turning motion is smoothly operated, the page surface is properly pressed and the open pages are stably supported for reading assistance.

In turning over the page by the page-turning-over means, if the page is set on the back of the supplementary page-pressing means, the page is pulled by the page-turning-over means and pulled out of the supplementary page-pressing means. At this moment, the supplementary page-pressing means can also be provided slightly over the page.

The page already turned over is led to the rear side of the supplementary page-pressing means by turning the supplementary page-pressing means downward. To lead the page placed on the topside of the supplementary page-pressing means to the rear side of the supplementary page-pressing means, for example, a pair of the supplementary page-pressing means is symmetrically and rotatably provided on the upper end or lower end of the open book. And the supplementary page-pressing means rotates, thus one end of the supplementary page-pressing means runs off the page surface, and the other end of the supplementary page-pressing means simultaneously goes up and runs on the page surface.

The supplementary page-pressing means is preferably interlocked with the page turning motion by the interlocking means, or alternatively the supplementary page-pressing means and interlocking means can be separately provided. Also, a pair of the supplementary page-pressing means can be symmetrically provided.

An appropriate contact area between the supplementary page-pressing means and page surface depends on how the shearing force is provided on the page surface. When the shearing force is vertically given to the page surface, comparatively small area of the page within a range of a few millimeters from the edge of the page should preferably be pressed so that the supplementary page-pressing means can easily run off the page surface when the shearing force is given to the page surface.

This supplementary page-pressing means provided on the upper end or lower end of the page enables the edge of the page to be vertically turned up. To horizontally turn up the page, the supplementary page-pressing means is preferably set to press the area within tens of millimeters from the edge of the page.

(12) The inventive apparatus is also characterized by comprising a centerline supporting means which is inserted into the centerline of the book so that the spine of the book can be fixed in the appropriate position.

Repeating a series of motion by the page pressing, page-turning-up and page-turning-over means may make the open book move out of the right position, and it will become difficult to turn over the page. It is also possible to provide a clip or the like as a supporting means for fixing the spine of the book.

However, in order to place a book in the right position and turn over the page correctly, it is important to provide an appropriate clearance on the supporting means, which enables the spine of the book to be slanted to the right or left in response to various thicknesses of the right and left pages.

Thus each motion of the page pressing, turning-up and turning-over means can be perfectly repeated.

A wire rod is preferably used for the centerline supporting means to be inserted into the center of the right and left pages so that the spine of the book can be supported. Such wire rod includes wire, cord, plastic bar or the like.

(13) The inventive apparatus is characterized by comprising a back supporting means which presses and holds the spine of the book from behind.

If the spine of the open book is not firmly supported by the supporting means, the book will become unstable, and the open pages will become too curved to be turned over.

In this invention, the spine of the book is supported by the back supporting means so that the surface of the open pages are horizontally spread and firmly fixed.

(14) The inventive apparatus is also characterized by comprising a page-stack pressing means which presses and supports the stack of the right and left pages from behind the book.

In general, there are two types of bookbinding. One is hardcover and the other is softcover for paperback books, magazines or the like. It may be difficult to turn over the page of the softcover book since the page surface is sometimes too curved to be turned up and turned over.

The page-stack pressing means in this invention can press and support the stack of the right and left pages from behind the book so that the page surface can be firmly set up and the stacks of curved pages are set straight. Thus, regardless of type of book, each page can be easily turned up and consistently turned over.

Said page-stack pressing means is a component to press and hold the stack of the open pages from behind the book. More precisely, the page-stack pressing means is a component to press and hold a front page cover, reverse page or the like from behind the book. Also, the cover means the first cover and back cover of the book, the reverse page means an inside and reverse of the cover, and the front page means a title leaf next to the reverse page of the book or the first page before the body text of magazines.

Also, the aforementioned page-stack pressing means is preferably a tilting type which slants depending on the thickness of the stack of the right and left pages. When the thicknesses of the right and left stacks are almost the same, the both stacks are symmetrically pressed in a most equal position by the stack pressing means. When there is a difference in thickness between the right and left pages, a pair of the stack pressing means tends to make balance as a tilting device does, and presses the different positions of the right and left pages from behind the book.

In this invention, if the page-stack pressing means is initially set on the appropriate position of the backside of the book depending on the thickness of the pages, the page-stack pressing means will be able to automatically fit on the thickness of the right and left pages which accordingly changes while reading.

To keep the thick hardcover book open, it is effective to use the back supporting means. To obtain the secure contact between the pressing means and the page surface, it is effective to use the stack pressing means. However, it is preferable to use the back supporting means and page-stack pressing means.

DESCRIPTION OF THE PREFERRED EMBODIMENTS

Embodiments in this invention will be described here according to the drawings.

Figure 1:
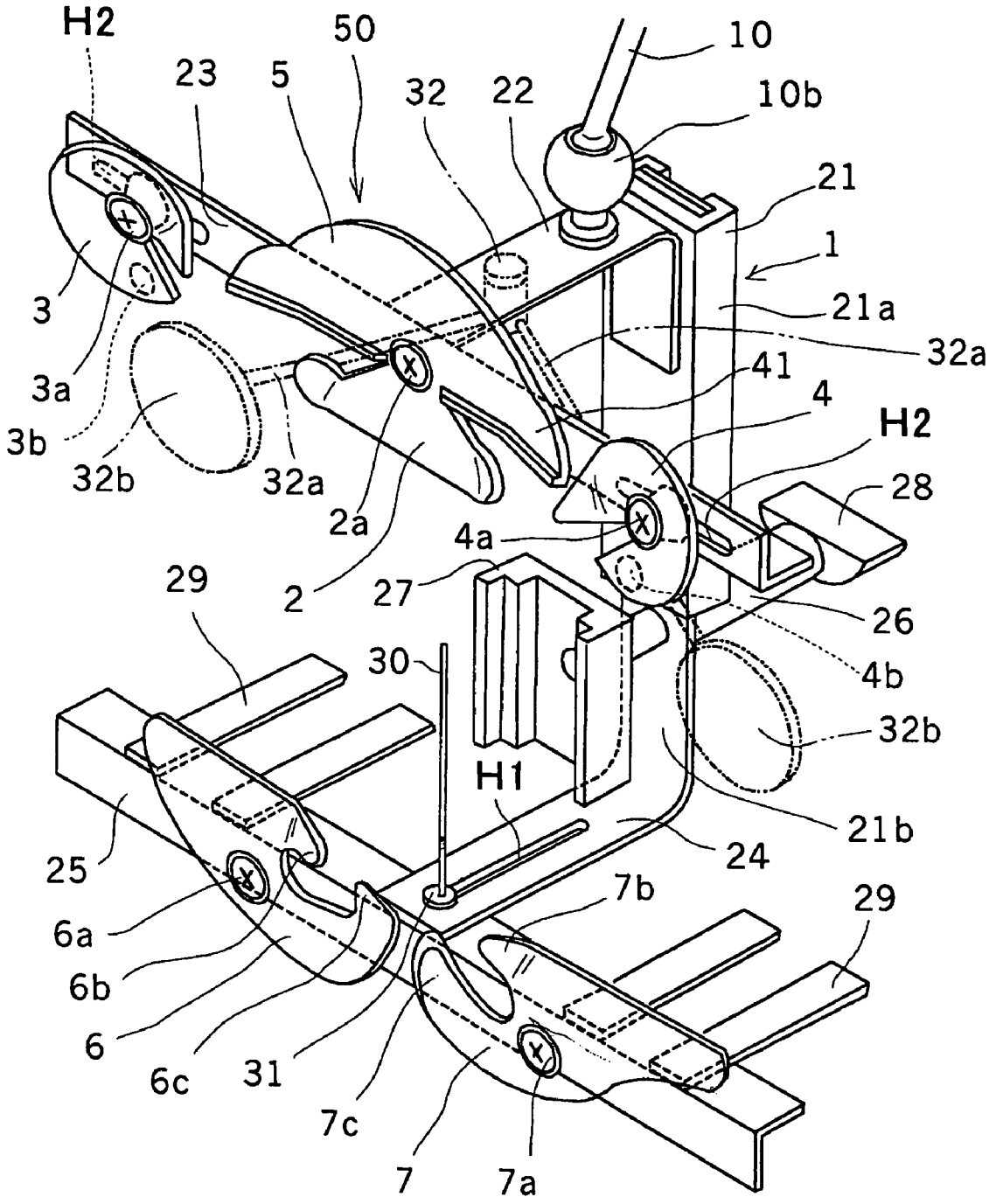
FIG. 1 is an oblique perspective figure of an apparatus having page turning capability for reading assistance as a first embodiment.

Referring to FIG. 1, an apparatus 50 comprises a supporting body 1 (supporting means) on which a page-pressing device 2 (page pressing means), page-turning-up devices 3, 4 (page-turning-up means), page-turning-over device 5 and supplementary page-pressing devices 6, 7 (supplementary page-pressing means) are provided. An open book is set on the supporting body 1 and the right and left page surfaces are pressed by the page-pressing device 2, page-turning-up devices 3 and 4, page-turning-over device 5 and supplementary page-pressing devices 6 and 7. The page-pressing device 2, page-turning-up devices 3 and 4, page-turning-over device 5 and supplementary page-pressing devices 6 and 7 properly rotate at the specified time so that the page of a book can be turned over one by one from right to left or from left to right. Thus, the inventive apparatus 50 comprises a capability to support the open book and turn over pages of the open book. Below are the descriptions of the apparatus 50 in respect to the page supporting, turning and driving devices.

(Structure of Book Supporting Device)

Figure 2:
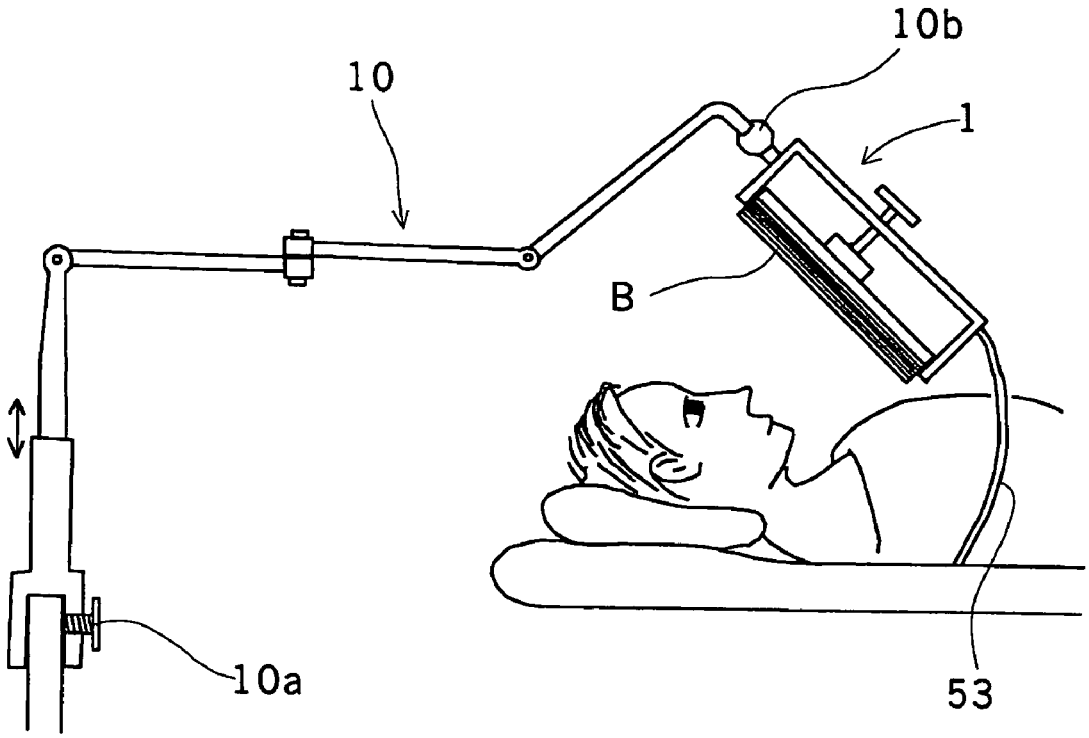
FIG. 2 shows a side view of the first embodiment in use.

As shown in FIG. 2, a loose-jointed arm 10 is provided on the book supporting body 1. The loose-jointed arm 10 is fixed on a desk or bed with a screw 10*a*. To support the book supporting body, a ball joint 10*b* is provided on an end of the loose-jointed arm 10. A book B can be properly fixed by adjusting the length and direction of the loose-jointed arm 10.

The loose-jointed arm 10 is fixed on the top of the book supporting body 1, and other positions such as the lower part or in the middle of the book supporting body 1.

The book supporting body 1 comprises a pillar 21, an upper-positioned vertical member 22, an upper-positioned horizontal member 23, a lower-positioned vertical member 24 and a lower-positioned horizontal member 25 (See FIG. 1). The upper-positioned vertical member 22 provided on the upper end of the pillar 21 and the lower-positioned vertical member 24 provided on the lower end of the pillar 21 extend forward. The upper-positioned horizontal member 23 and lower-positioned horizontal member 25 horizontally extend on the both ends of the vertical members 22 and 24. The open book is supported between the upper-positioned horizontal member 23 and the lower-positioned horizontal member 25.

The pillar 21 comprises a frame member 21*a* and an axial member 21*b*. The axial member 21*b* is slidably inserted into the frame member 21*a* having a channel-shaped sectional surface. A fixing screw provided on the back of the pillar 21 is tightened so that the axial member 21*b* is fixed on the desired position of the frame member 21*a*. To set the book on the book supporting body 1, slide the frame member 21*a* and axial member 21*b* to the appropriate positions according to the height of the book, and at the same time the distance between the upper-positioned horizontal member 23 and lower-positioned horizontal member 25 can be properly adjusted to the size of the book.

A pushrod 26 is inserted into the midsection of the pillar 21. A channel-shaped guide 27 (back supporting means) to receive and support the back of the book is rotatably fixed on the end of the pushrod 26. A handle 28 is provided on the rear end of the pushrod 26. When rotating the handle 28, the guide 27 moves back and forth in the axial direction of the pushrod 26. The spine of the book is properly positioned by controlling the handle 28 according to the thickness of the book.

A channel H2 is horizontally provided on the upper-positioned horizontal member 23. The page-pressing devices 3 and 4 can be slidably positioned along the channel H2. To set the open book on the book supporting body 1, place the page-pressing devices 3 and 4 respectively on the upper-left corner of the left page and on the upper-right corner of the right page.

Bed plates 29 are provided at certain distance on the lower-positioned horizontal member 25. The bed plates 29 extend horizontally to rearward of the lower-positioned horizontal member 25 and prevent the book from dropping down from the book supporting body 1.

A centerline supporting pin 30 (centerline supporting means) is provided on the lower-positioned vertical member 24. A disk 31 is fixed on the bottom of the centerline supporting pin 30 and slidably engaged with the vertical channel H1 extending along the lower-positioned vertical member 24. The centerline supporting pin 30 vertically moves along the vertical channel H1 so that the centerline supporting pin 30 can be inserted into the centerline between the right and left pages of the book.

To firmly set the open book on the book supporting body 1, insert the centerline supporting pin 30 into the center of the open book so that both stacks of the right and left pages are equally supported.

A channel-shaped guide 27 is provided to receive and push the spine of the book. Thus, the centerline of the book is properly positioned, and the spine of the book can be flexibly and gently fixed without trembling, which eventually creates a better reading environment. Therefore, even if there is a difference in thickness between the right and left stacks of paper, the open page surfaces will always be well-balanced.

Also, the centerline supporting pin 30 can be provided on the upper-positioned vertical member 22 in the alternative embodiment instead of the lower-positioned vertical member 24 in this embodiment. Furthermore, instead of the centerline supporting pin 30, other materials such as wire, thick lace, thick string or the like can be inserted into the centerline of the open book.

A stack holding arm 32 (stack holding means) is provided on the bottom of the upper-positioned vertical member 22. The stack holding arm 32 comprises arms 32*a*, 32*a* and supporting pads 32*b*. A pair of the arms 32*a* is symmetrically provided on the bottom of the upper-positioned vertical member 22, and a supporting pad 32*b* is provided on each end of the arms 32*a*. When the open book is placed on the book supporting body 1, the supporting pad 32*b* contacts the right and left cover pages, and then the page surfaces are gently pressed from behind with spring action of the arm 32*a*. Eventually, the open book is firmly set up and the page can be turned up by the page-turning-up devices 3 and 4, then, smoothly turned over.

(Structure of Page Turning Device)

Page turning structure of this inventive apparatus 50 will be here described.

The page turning structure comprises a page-pressing device 2, page-turning-up devices 3 and 4, page-turning-over device 5 and supplementary page-pressing devices 6 and 7. As described below, the page-pressing device 2 and page-turning-over device 5 formed as a unit move together.

The page-pressing devices 3 and 4 are rotatably supported on both ends of the upper-positioned horizontal member 23 with pivots 3*a* and 4*a*. The right and left page surfaces are turned up by the page-turning-up devices 3 and 4 which are symmetrically provided.

Figure 3:
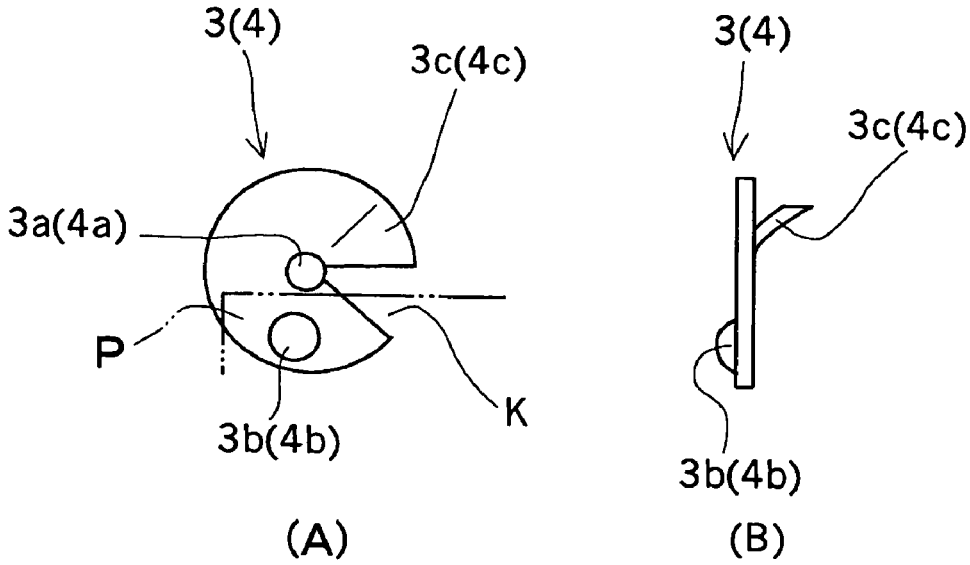
FIG. 3 is a page-turning-up device (page-turning-up means) of the first embodiment in which FIG. (A) is a flat view and FIG. (B) is a side view.

As shown in FIG. 3, mats 3*b* and 4*b* made of viscoelastic material are provided on the surface of the page-turning-up devices 3 and 4. Each of the mats 3*b* and 4*b* has a semispheric face which contacts the page surface. While the page-turning-up devices 3 and 4 are rotatably moving, frictional force is generated between the mats 3*b*, 4*b* and the page surfaces, and then the page is turned up in an anterior direction of the page-turning-up devices 3 and 4.

To turn up the page as described above. The initial position of the mats 3*b* and 4*b* are set on the lower side of the pivots 3*a* and 4*a*. When the page-turning-up device 3 or 4 rotates, the shearing force is generated on the page surface and transmitted from the edge to the midsection of the right or left page, and eventually the page is turned up.

Viscoelastic material such as resin, rubber or the like is used for the mats 3*b* and 4*b*. It is preferable to use urethane resin with an appropriate viscosity, strength and excellent durability, which generates frictional force sufficient to turn up the page. Although the semispheric shaped mat is used in this embodiment, other shapes such as rectangular, disk, projection, wave, hollow ball are also acceptable.

A cut portion K is provided on the page-pressing devices 3, 4 (FIG. 3). Bend portions 3*c*, 4*c* are provided on the area adjacent to the cut portion K. When the page-pressing devices 3, 4 (FIG. 1) rotates clockwise having a page P under the cut portion K (FIG. 3), the bend portions 3*c*, 4*c* run on the page P. Thus, the page P can be forwarded from the top to the rear side of the page-pressing devices 3, 4 by turning the cut portions 3*c*, 4*c* into the side of the cut portion K.

Figure 4:
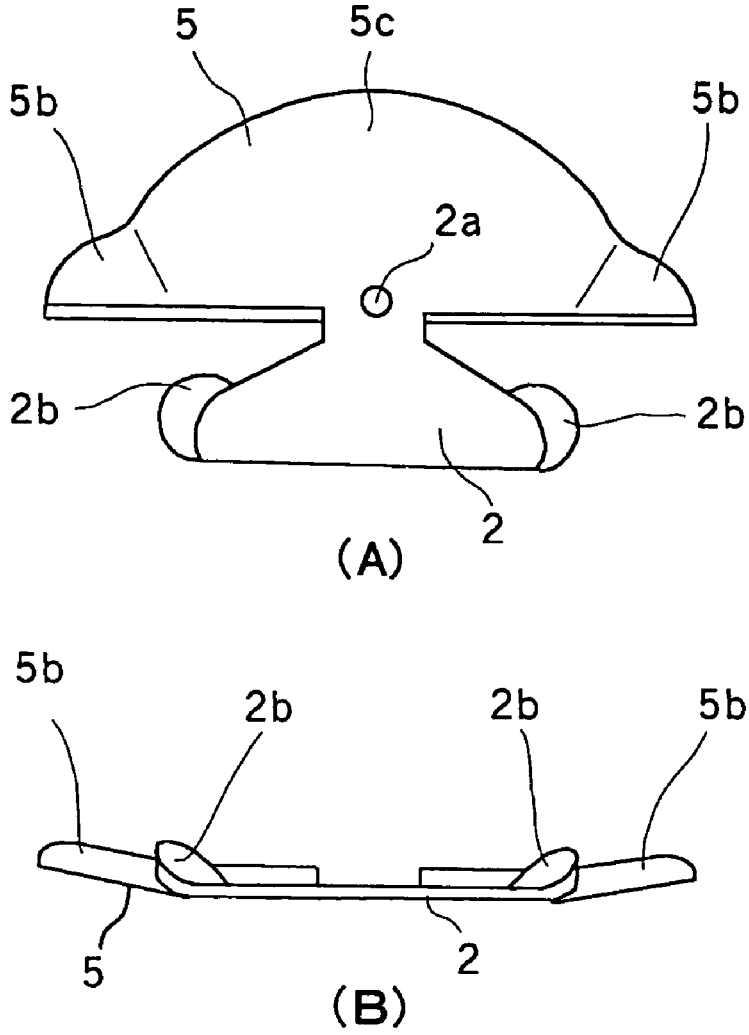
FIG. 4 is a page-turning-over device (page-turning-over means) of the first embodiment in which FIG. (A) shows a flat view and FIG. (B) shows a bottom view.

The page-pressing device 2 and page-turning-over device 5 are rotatably supported with a pivot 2*a* in the middle of the upper-positioned horizontal member 23. As shown in FIG. 4, the page-pressing device 2 and page-turning-over device 5 are vertically formed around the pivot 2*a*. Also, the horizontal length of the page-pressing device 2 is shorter than that of the page-turning-over device 5. When the page-pressing device 2 rotates, the page-turning-over device 5 also rotates at the same rotation angle of the page-pressing device 2.

When the page-pressing device 2 is located downward, the upper midsection of the right and left pages are pressed by the page-pressing device 2. At this time, the page-turning-over device 5 is located away from the pages. When the page-pressing device 2 rotates clockwise or anticlockwise, the page-pressing device 2 runs off the page surface. On the other hand, both edges of the page-turning-over device 5 turn from side to side so that the page is turned over.

Both ends of the page holding device 2 and page-turning-over device 5 respectively comprise bend portions 2*b*, 2*b* and 5*b*, 5*b* which are pressed upward with certain angle of inclination so as to face front. The bend portions 2*b*, 5*b*, when rotating, run on the page surfaces and prevent the edges of the page-pressing device 2 and page-turning-over device 5 from being stuck on the pages.

A page pressing portion 5*c* is provided on the page-turning-over device 5, and is connected to the page holding device 2. Thus, while the page-turning-over device 5 is turning the page, the following page is pressed by the back side of the page pressing portion 5*c*.

As shown in FIG. 1, the supplementary page-pressing devices 6, 7 are rotatably and symmetrically provided on the lower-positioned horizontal member 25 with the pivots 6*a*, 7*a*. The upper part of the pivots 6*a*, 7*a* press the lower part of the page surface. The supplementary page-pressing device 6 presses the left page and the other page-pressing device 7 presses the right page.

Bend portions 6*a*, 7*b* are formed back to back on the supplementary page-pressing devices 6, 7 (FIG. 1). The bend portions 6*b*, 7*b* are pressed upward with certain angle of inclination so as to face front. In FIG. 1, when the supplementary page-pressing device 6 rotates anticlockwise and the other page-pressing device 7 rotates clockwise, the supplementary page-pressing devices 6, 7 run off the page surfaces. When the supplementary page-pressing devices 6, 7 reversely rotate and return to the initial positions, the bend portions 6*b*, 7*b* run up to the lower part of the page surfaces, which prevents the supplementary page-pressing devices 6, 7 from being stuck on the page surfaces.

Also, key portions 6*c*, 7*c* are symmetrically provided on the supplementary page-pressing devices 6, 7. As shown in FIG. 1, the key portions 6*c*, 7*c* are located on a position lower than the bend portions 6*b*, 7*b*.

Referring to FIG. 1, when the page surfaces are located on the supplementary page-pressing devices 6, 7, the bottom end s of page surfaces are located just above the key portions 6*c*, 7*c*. If the supplementary page-pressing device at this stage rotates anticlockwise, the key portions 6*c*, 7*c* run up to the page surfaces which are located on the supplementary page-pressing devices 6, 7 and send the page downward. At the same time, the bend portions 6*b*, 7*b* run off the lower part of the page surface.

(Structure of Moving Part)

Figure 5:
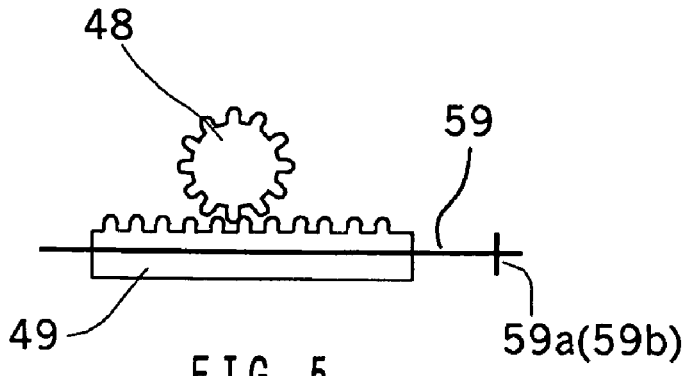
FIG. 5 is a partially-enlarged view of a driving part (interlocking means) of the apparatus as the first embodiment.

As shown in FIG. 5, the page-pressing device 2, page-turning-up devices 3, 4, page-turning-over device 5 and supplementary page-pressing devices 6, 7 are respectively activated by a pinion gear 48 and rack gear 49. When the rack gear 49 moves along the upper-positioned horizontal member 23 or the lower-positioned horizontal member 25, the pinion gear 48 starts rotating, and then the page-pressing device 2, page-turning-up devices 3, 4, page-turning-over device 5 and supplementary page-pressing devices 6, 7 rotate at the specified rotation angle. The pinion gear 48 and rack gear 49 are preferably installed as a unit in the page-pressing device 2, page-turning-up devices 3, 4, page-turning-over device 5 and supplementary page-pressing devices 6, 7. The page-pressing device 2 and page-turning-over device 5 rotate together and can be activated by a pair of pinion gear 48 and rack gear 49.

Figure 6:
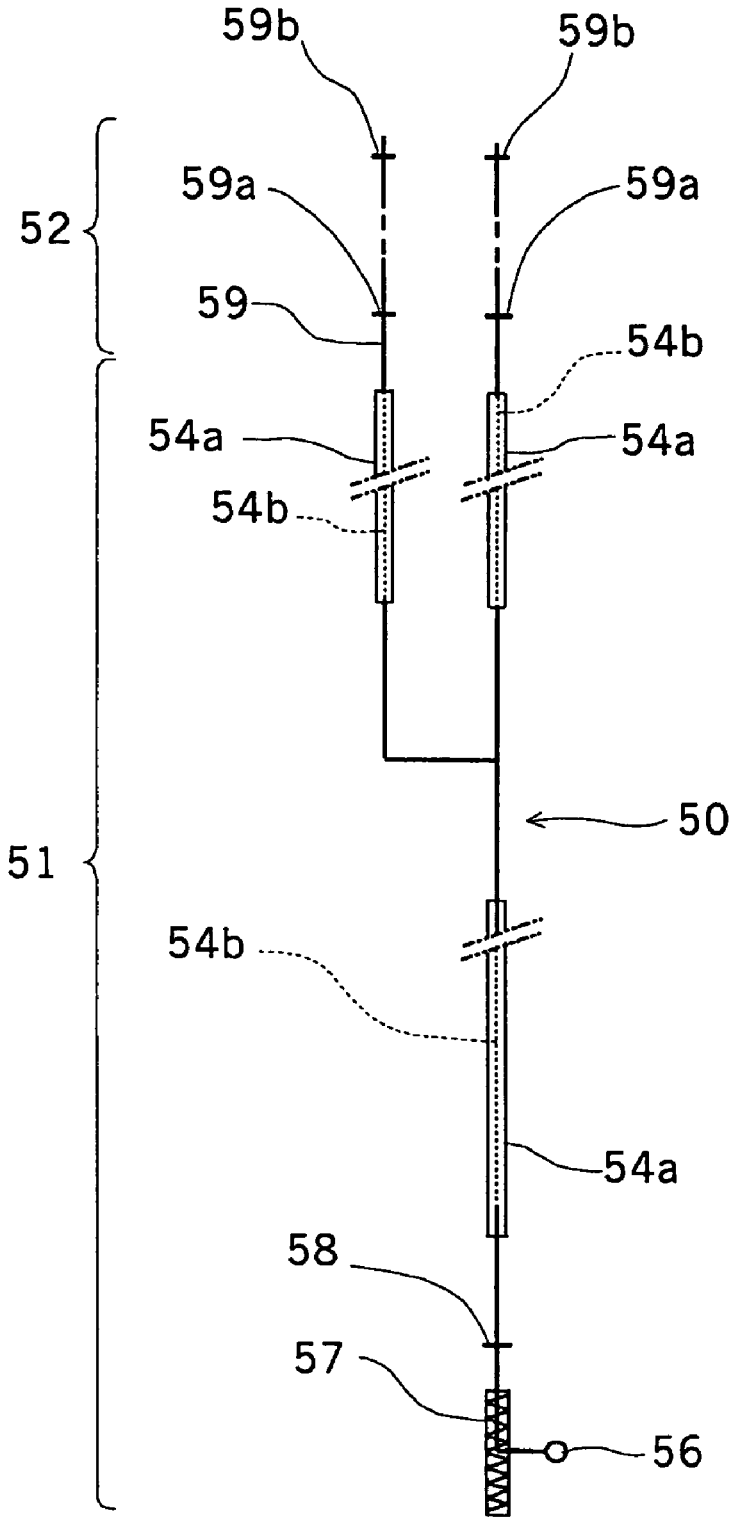
FIG. 6 is a schematic over view of a cable system showing an interlocking means and remote handling means of the first embodiment.

FIG. 6 refers a cable system 50 to activate the pinion gear 48 and rack gear 49. The cable system 50 consists of a movable handling cable 51 (remote handling means) and an interlocking unit 52 (interlocking means).

The handling cable 51 has a structure in which one cable is bifurcated. An inner cable 54*b* is slidably inserted into an outer tube 54*a*. The outer tube 54*b* is fixed on the specified place of the book supporting body 1 or the like. A knob 56 and a return spring 57 are provided on the end of a single cable (unbranched part) of the handling cable 51. A core material 59 for the interlocking unit 52 is connected to an end of a double cable (branched part) of the handling cable 51.

When pushing or pulling the knob 56, the inner cable 54*b* moves inside the outer tube 54*a*, and subsequently the moving force is given to the core material 59. When releasing the knob 56, the inner cable 54*b* returns to the original position by the spring force of the return spring 57, and at the same time, reverse moving force is given to the core material 59. In other words, when the inner cable 54*b* moves, the core material 59 also moves the same distance.

The knob 56 is connected to a stopper 58 which moves together with the inner cable 54*b*. The stopper 58 controls the moving distance of the knob 56 and prevents the core material 59 from receiving unnecessary moving force.

Figure 7:
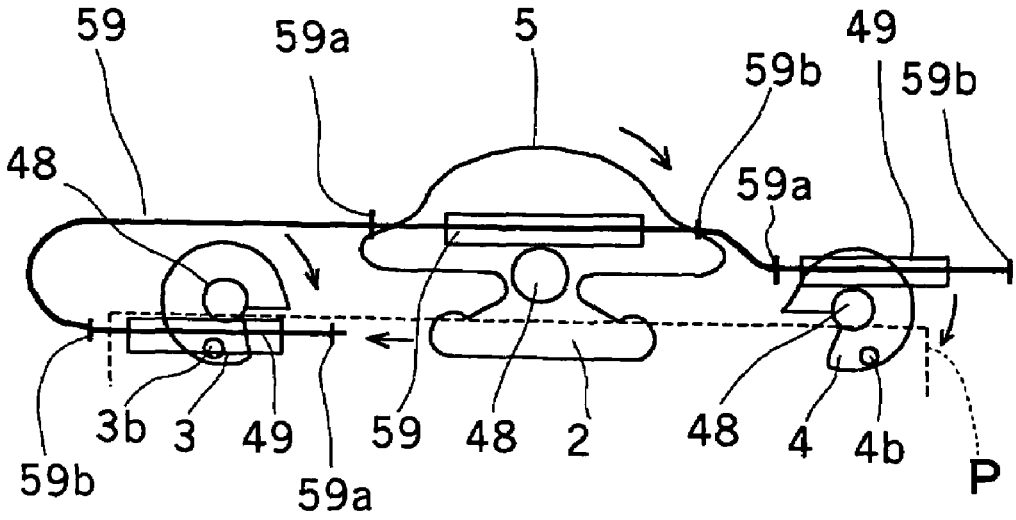
FIG. 7 is an interlocking unit (interlocking means) of the first embodiment showing a frame format which describes a series of motion produced by a page pressing means, page-turning-up means and page-turning-over means.

One of the core materials 59, 59, as shown in FIG. 7, is connected to each rack gear 49 provided on the page-pressing device 2 (page-turning-over device 5), page-turning-up devices 3, 4. The core material 59 is slidably inserted into each rack gear of the page-turning-up device 3, page-pressing device 2 (page-turning-over device 5), and then page-turning-up device 4.

Figure 8:
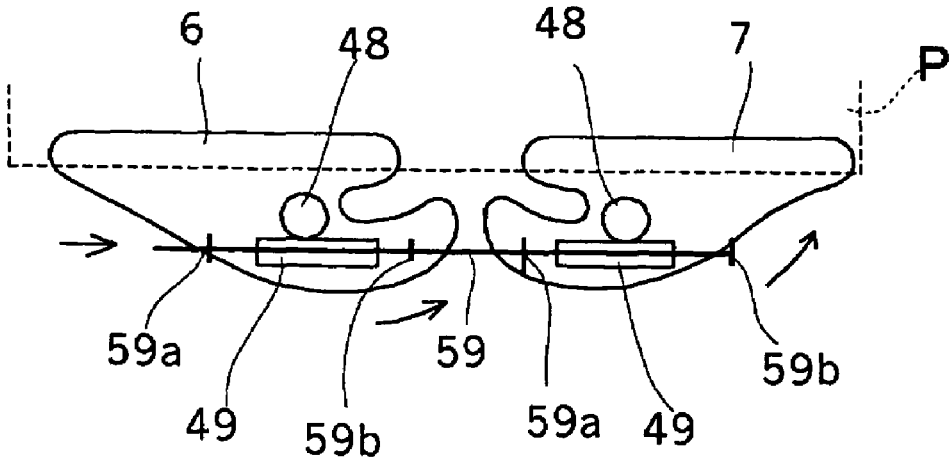
FIG. 8 is a frame format which describes a series of motion produced by a supplementary page-pressing device (supplementary page-pressing means) showing an interlocking unit (interlocking means) of the first embodiment in this invention.

The other core material 59, as shown in FIG. 8, is connected to each rack gear 49 provided on the supplementary page-pressing devices 6, 7. The core material 59 is slidably inserted into each rack gear 49 of the supplementary page-pressing devices 6, 7.

As shown in FIGS. 7 and 8, the core material 59 has locking parts 59*a*, 59*b* which are fixed on both sides of each rack gear 49 at a certain distance. When the core material 59 moves inside the rack gear 49, the locking parts 59*a*, 59*b* move from side to side of the rack gear 49.

In FIGS. 7 and 8, when the knob 56 is pushed in, the pushing force is given to the core material 59 through the inner cable 54*b*, and the locking parts 59*a*, 59*b* move the same distance that the knob 56 moves. At the same time, the locking part 59 a pushes one end of the rack gear 49, and as indicated by arrows in FIGS. 7 and 8, the page-pressing device 2, page-turning-up devices 3, 4, page-turning-over device 5 and supplementary page-pressing devices 6, 7 rotate respectively.

When releasing the knob 56, the core material 59 is pushed by the return spring 57, and then the knob 56 and locking parts 59*a*, 59*b* return to the original positions.

On the other hand, in FIGS. 7 and 8, when the knob 56 is pulled, the reverse motion is activated, in other words, the locking parts 59*b* pushes the other end of the rack gear 59 in the counter direction, and then the page-pressing device 2, page-turning-up devices 3, 4, page-turning-over device 5 and supplementary page-pressing devices 6, 7 rotate in a direction opposite to the arrows in FIGS. 7 and 8.

Each distance among the rack gear 49, locking parts 59*a* and 59*b* should be adjusted in advance in respect to the moving order of the page-turning-up devices 3, 4 page-turning-over device 5 and supplementary page-pressing devices 6, 7. In other words, such difference in each distance activates an interval difference mode to move the page-turning-up devices 3, 4, page-turning-over device 5 and supplementary page-pressing devices 6, 7.

For instance, if distances among the rack gear 49, locking pats 59*a* and 59*b* are short, the locking parts 59*a*, 59*b* will hit the rack gear 49 immediately after operating the knob 56, which accelerates the motion starting time. On the other hand, if the distances among the rack gear 49, locking parts 59*a* and 59*b* are long, the locking parts 59*a*, 59*b* hit the rack gear 49 belatedly after operating the knob 56, which delays the motion starting time. Also, the pushing and pulling distances of the knob 56 are preferably set in the range of 20 to 50 millimeters.

In such cable system 50, operating the knob 56 enables the page-pressing devices 2, page-turning-up devices 3, 4, page-turning-over device 5 and supplementary page-pressing devices 6, 7 to be interlocked at certain intervals. And the pages can be easily turned over with a single touch, which makes it possible to provide a good environment for the person who spends time on reading.

Also, the person who is reading does not need to hold a book and turn over the pages while in use of this cable system 50. The outer tubes 54*a*, 58*a* are fixed on the specified places of the book supporting body 1, therefore, the book supporting body 1, arm 10 or the like will not be easily trembled even if the knob 56 is operated.

A conventional apparatus for reading assistance which is manually operated by the person lying down has a large and complicated structure made of thick steel pipes to prevent the overhead oscillation. This new inventive apparatus having the cable system 50 has structurally significant points which can be simplified and downsized by the arm 10 and book supporting body 1.

Also, as an alternative type of the cable system 50, the knob 56 can be operated by a motor or the like. Furthermore, each rack gear 49 of the page-turning-up devices 3, 4, page-turning-over device 5 and supplementary page-pressing devices 6, 7 can be activated directly by the motor. A return spring 57 can be provided on each rack gear 49 of the page-turning-up devices 3, 4, page-turning-over device 5 and supplementary page-pressing devices 6, 7.

A series of page turning motion of the apparatus 50 will be described here referring to FIGS. 9 to 13.

Figure 9:
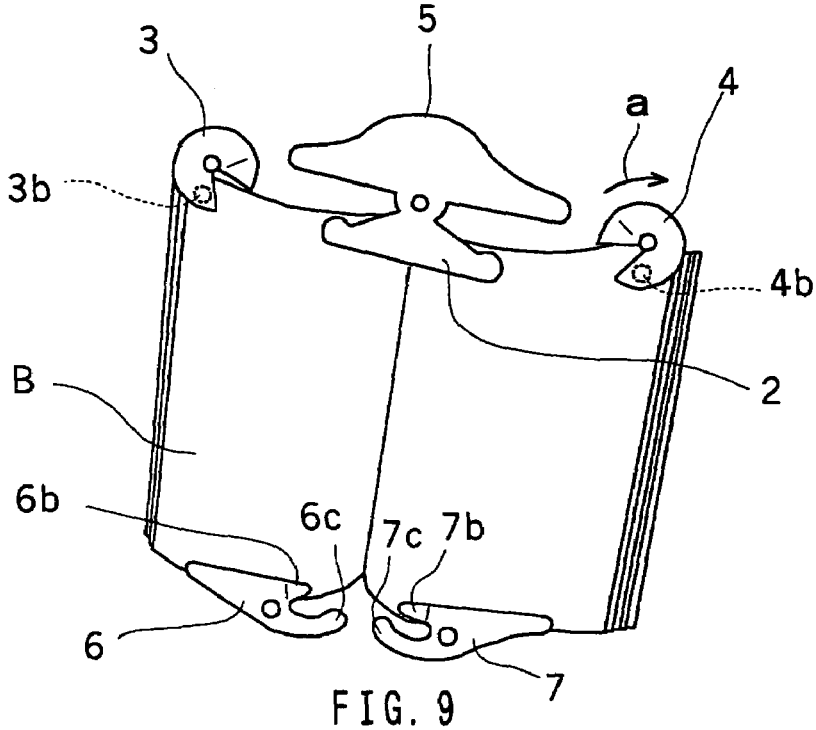
FIGS. 9 to 13 are oblique perspective views to describe a series of page turning motions created by the inventive apparatus of the first embodiment.

Firstly, an open book B is set on the book supporting body 1 and the pages are pressed by the page-pressing device 2, page-turning-up devices 3, 4 and supplementary page-pressing devices 6, 7 (FIG. 9). At this time, the page-pressing device 2 is located over the upper midsection between the right and left pages, and the mats 3*b*, 4*b* are placed on the upper corners of the left and right pages respectively. And the supplementary page-pressing devices 6, 7 are placed symmetrically and back to back on the bottom part of the left and right pages.

The page-pressing device 2, page-turning-up devices 3, 4 and supplementary page-pressing devices 6, 7 press and support the page margins so that reading is not disturbed.

To turn over the page of the open book B from right to left, push in the knob 56 of the cable system 50, and then the page-turning-up device 4 starts rotating in a direction as indicated by an arrow in FIG. 9*a* and the mat 4*b* presses and turns up the right page surface toward the page-pressing device 2. At this time, as shown in FIG. 10, the page surface between the page-pressing device 2 and the mat 4*b* is bent into an arch so as to be turned up.

Figure 10:
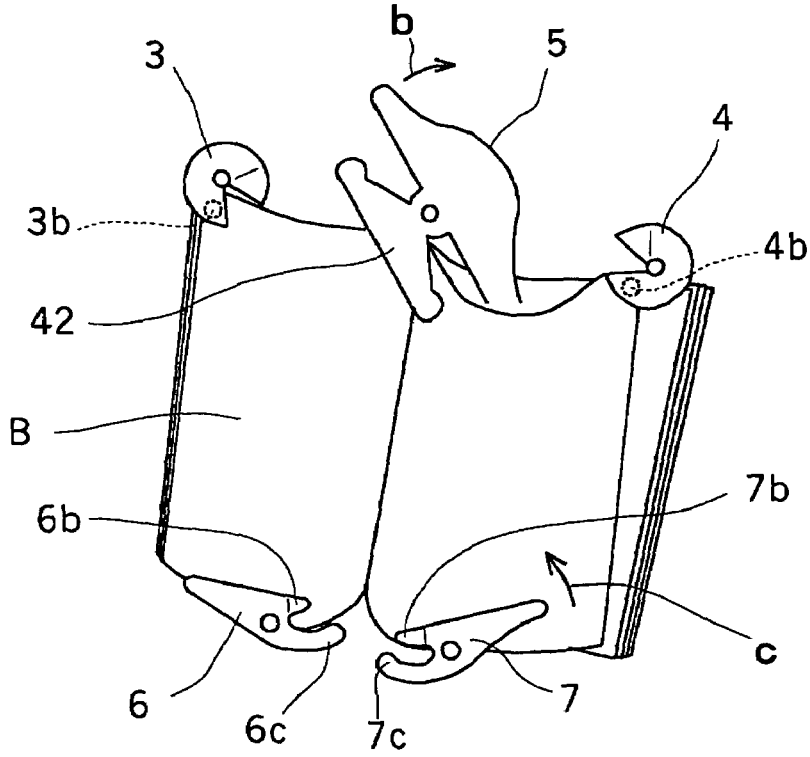

Then, the page-turning-over device 5 rotates in a direction as indicated by an arrow b in FIG. 10, and the edge of the page-turning-over device 5 slips into the back of the page. As indicated by an arrow c in FIG. 10, the supplementary page-pressing device 7 goes up so that the page surface can easily come off the supplementary page-pressing device 7. Also, the supplementary page-pressing device 7 preferably rotates inward by 30 to 90 degrees so that the page surface easily comes off the supplementary page-pressing device 7.

Figure 11:
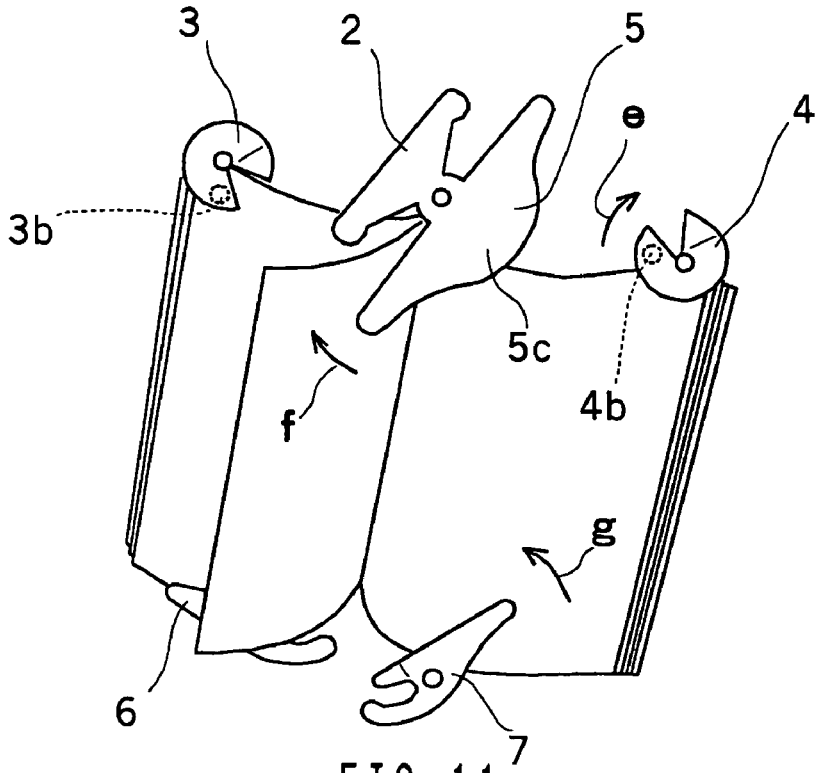

As indicated by arrows e, f, and g in FIG. 11, when the rotation angles of the page-turning-up device 4, page-turning-over device 5 and supplementary page-pressing device 7 increase, the page comes off the page holding device 2, the page pressing portion 5*c* of the page turning-over device 5 presses the page surface downward, and then the page is pressed, turned up and turned over from right to left. The page surface is pulled obliquely upward, and comes off the mat 4*b* and supplementary page-pressing device 7, and then the page is turned over to the left side. Then the page is placed upon the page-turning-up device 3 and supplementary page-pressing device 6.

As described above, while the right page is being turned over to the left side the page-turning-up device 3 and supplementary page-pressing device 6 remains still.

Figure 12:
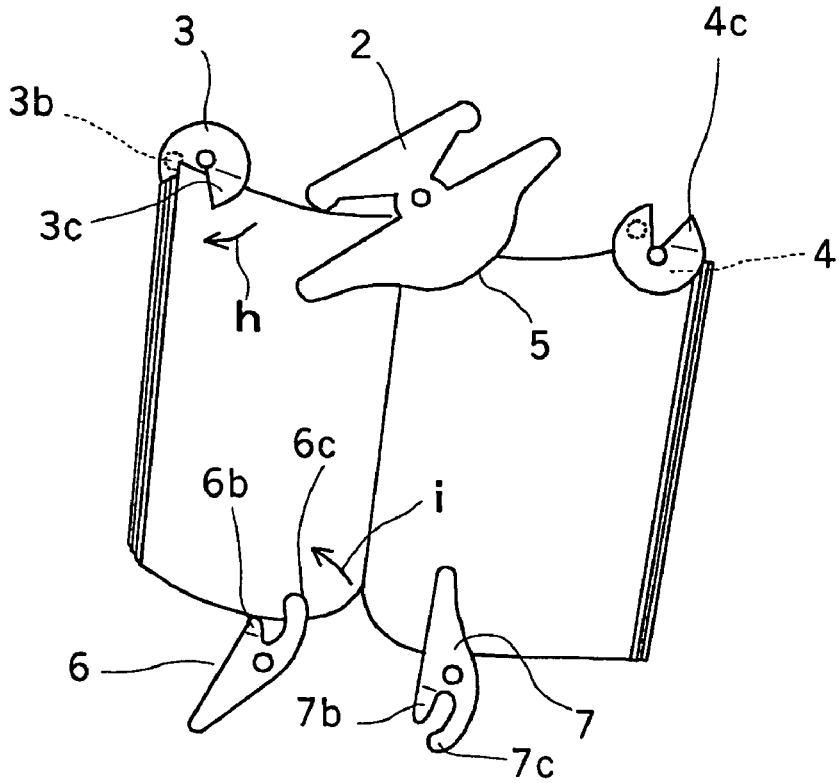

Afterward, as shown in FIG. 12, the page-turning-up device 3 and supplementary page-pressing device 6 start rotating. When the page-turning-up device 3 rotates in a direction as indicated by an arrow h in FIG. 12, the mat 3*b* runs off the page surface and the bend portion 3*c* runs on the page surface. At the same time, when the supplementary page-pressing device 6 rotates in a direction as indicated by an arrow i, the key portion 6*c* of the supplementary page-pressing device 6 picks up and presses the page surface, and then the bend portion 6*b* once runs off the page surface.

At this time, the knob 56 is completely pushed in, and each rotation of the page-pressing device 2, page-turning-up devices 3, 4 page-turning-over device 5 and supplementary page-pressing devices 6, 7 stops.

As understood from the above explanations concerning a series of page tuning motion, the page surfaces are always pressed and supported by the page-turning-up device 3 and page-turning-over device 5 as well as the supplementary page-pressing device 6. As result, this invention can provide a new inventive apparatus 50 which prevents the book from dropping and keeps the condition of the page surfaces suitable for smooth reading.

Figure 13:
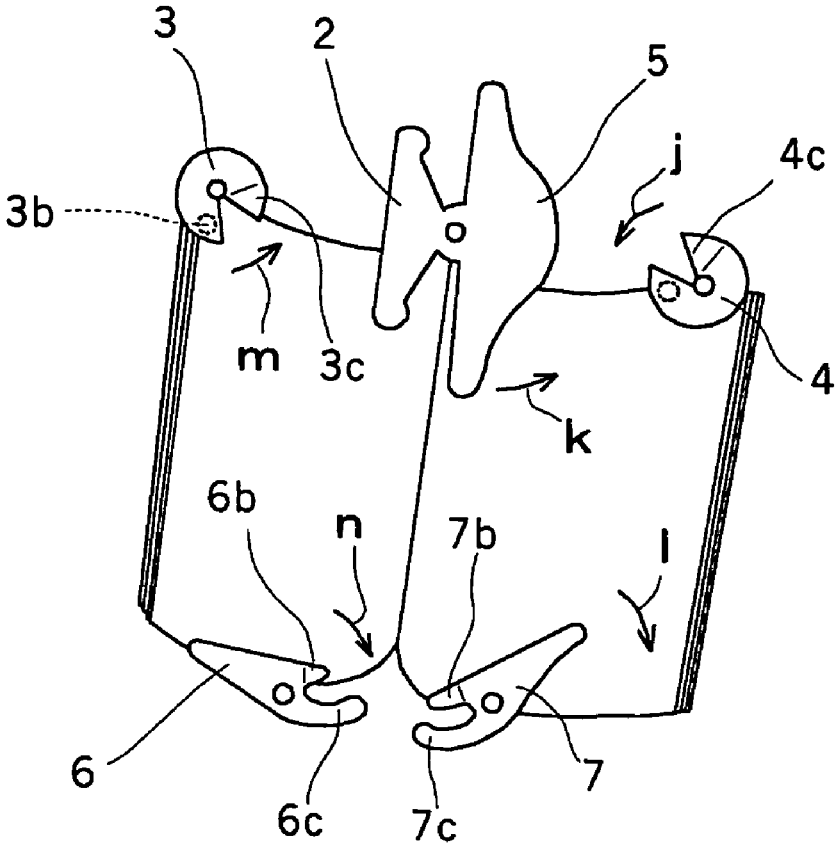

When releasing the knob 56, the return spring 57 activates the page-pressing device 2, page-turning-up devices 3, 4 page-turning-over device 5 and supplementary page-pressing devices 6, 7 to reversely rotate (FIG. 13). The page-turning-up device 4 rotates in a direction as indicated by an arrow j, the page-pressing device 2 and page-turning-over device 5 rotate in a direction as indicated by an arrow k, the supplementary page-pressing device 6 rotates in a direction as indicated by an arrow 1, and then all the devices return to the original positions as shown in FIG. 9.

As described in the above referenced FIGS. 9 to 13, a series of right-to-left page turning operation can be completely conducted.

On the other hand, in order to conduct the left-to-right page turning operation, pull the knob 56, so that the page-pressing device 2, page-turning-up devices 3, 4, page-turning-over device 5 and supplementary page-pressing devices 6, 7 reversely rotate.

Thus, the inventive apparatus enables the person to easily operate the knob 56 and properly turn over the page of the book B. For example, the person sitting in the chair or lying down on the bed can easily turn over the page by manually operating the know 56.

A second embodiment will be explained here referring to FIG. 14. The second embodiment comprises a tilting type of a page stack pressing arm.

Figure 14:
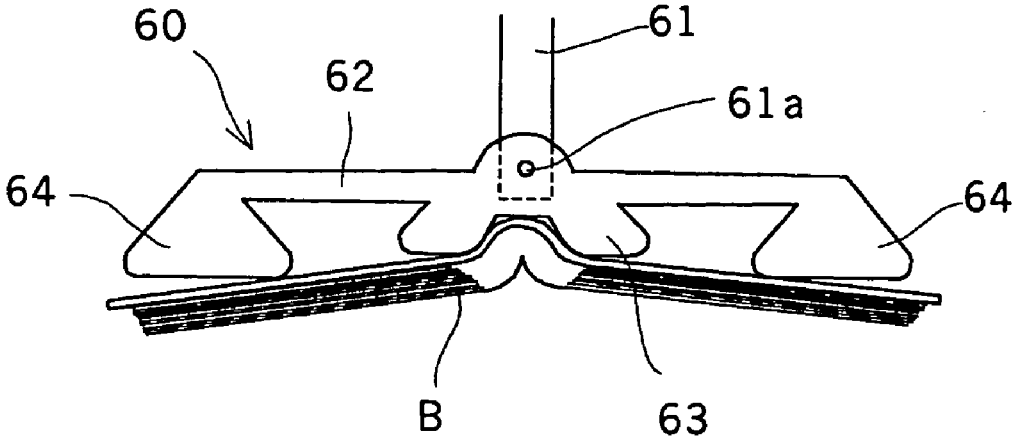
FIG. 14 is a flat view of a paper-stack pressing arm (paper-stack pressing means) as a second embodiment of the invention.

As shown in FIG. 14, a page stack pressing arm 60 comprises a swing arm 62 which is connected to a main support 61 with a pivot 61*a*. A back supporting guide 63 is provided in the center of the swing arm 62. Page stack supporting devices 64, 64 are provided on both ends of the swing arm 62.

Figure 15:
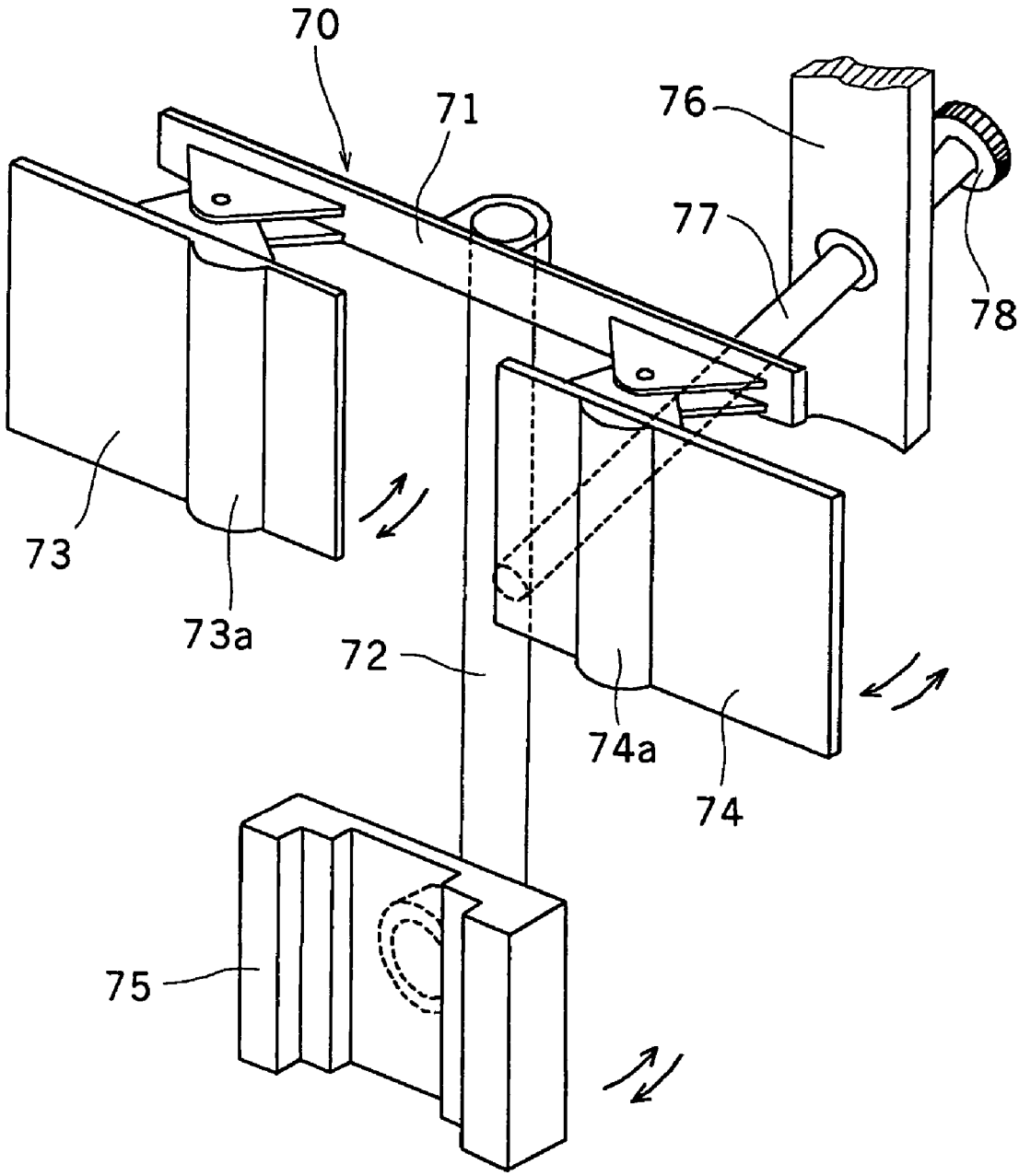
FIG. 15 is an oblique perspective view of the paper-stack pressing arm (paper-stack pressing means) as a third embodiment.

The back supporting guide 63 pushes the spine of the book B from behind. The swing arm 62 keeps balance depending on the thickness of the right and left pages and properly pushes the right and left cover pages. When there is a difference in thickness of the right and left pages, as shown in FIG. 4, the page stack supporting device 64 supporting a thicker page stack moves to the upper side of the book, on the other hand, the page stack supporting device supporting a thinner page stack moves to the lower side of the book. Thus, the right and left pages are supported in a well-balanced condition FIG. 15 shows a third embodiment comprising a page-stack supporting arm which moves back and forth.

Supporting devices 73, 74 are provided on both ends of an upper-positioned horizontal member 71 of a page-stack supporting arm 70. A main pillar 72 is vertically fixed in the center of the upper-positioned horizontal member 71, and a back supporting guide 75 having a channel-shaped cross-section surface is provided on the lower part of the main pillar 72. A pushing bar 77 extends from the back of the main pillar 72 into the frame 76.

A handle 78 is provided on the rear end of the pushing bar 77. When rotating the handle 78, the pushing bar 77 moves back and forth, then the supporting devices 73, 74 and the back supporting guide 75 also move back and forth.

To set a book on the book supporting body, firstly place the supporting devices 73, 74 on the front cover and back cover of the open book and place the back supporting guide 75 on the spine of the book. Secondly, turn the handle 8 and move forward the supporting devices 73, 74 and back supporting guide 75 so that the supporting devices 73, 74 and back supporting guide 75 can be properly positioned.

As described above, when the handle is initially positioned according to the thickness of the book, the back supporting and the right-and-left page stack supporting functions are sufficiently controlled for smooth reading.

As indicated by arrows in FIG. 15, the supporting devices 73, 74 and the back supporting guide 75 can be horizontally swung. Also, the upper-positioned horizontal member 71 is rotatably supported with the main pillar 72. Therefore, while turning over the page, the supporting devices 73, 74 and the back supporting guide 75 can be properly balanced according to the thickness of the right and left pages.

Vertically-extending convex portions 73*a*, 74*a* having 2 to 5 millimeters in height are formed on the supporting devices 73, 74. For example, if the page-stack supporting arm 70 is used for a soft cover book, the page surface will be raised up by the convex portions 73*a*, 74*a*.

By using the page-stack supporting arm 70, the right and left stacks and spine of the book are directly pressed from behind, and the page-pressing device, page-turning-up device, page-turning-over device and supplementary page-pressing device can easily contact the page surface. Therefore, the page surface can be smoothly turned up and each page can be properly turned over.

Figure 16:
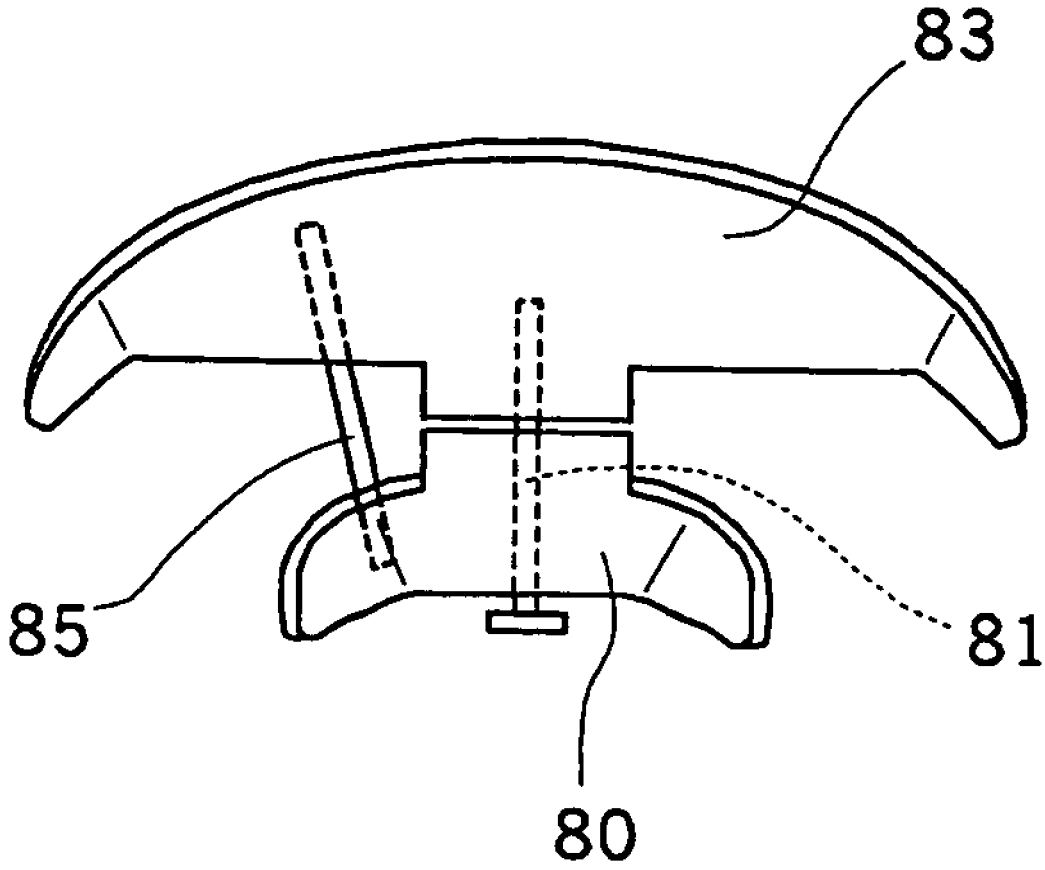
FIG. 16 is a front view of a page-pressing device (page pressing means) of a forth embodiment.

FIG. 16 shows a fourth embodiment comprising a pressing device which rotates back and forth.

As shown in FIG. 16, a page-pressing device 80 is connected to a page-turning-over device 83 with a spindle 81. The page-pressing device 80 and page turning-over device 83 respectively move around the spindle 81. A rod-like spring member 85 is placed between the page-pressing device 80 and page-turning-over device 83. One end of the spring member 85 is glued to the back side of the page-pressing device 80 and page-turning-over device 83. The page-pressing device and page-turning-over device are balanced to become flat by the spring member 85.

When the thicknesses of the right and left stacks are different, the page pressing device 80 swings left and right around the spindle 81 (FIG. 16). Thus, the right and left pages are pressed in a well-balance manner by the page-pressing device 80. At this time, the page-turning-over device 83 does not move. When the page-pressing device 80 runs off the page surface, the page-turning-over device 83 returns to the original position.

Figure 17:
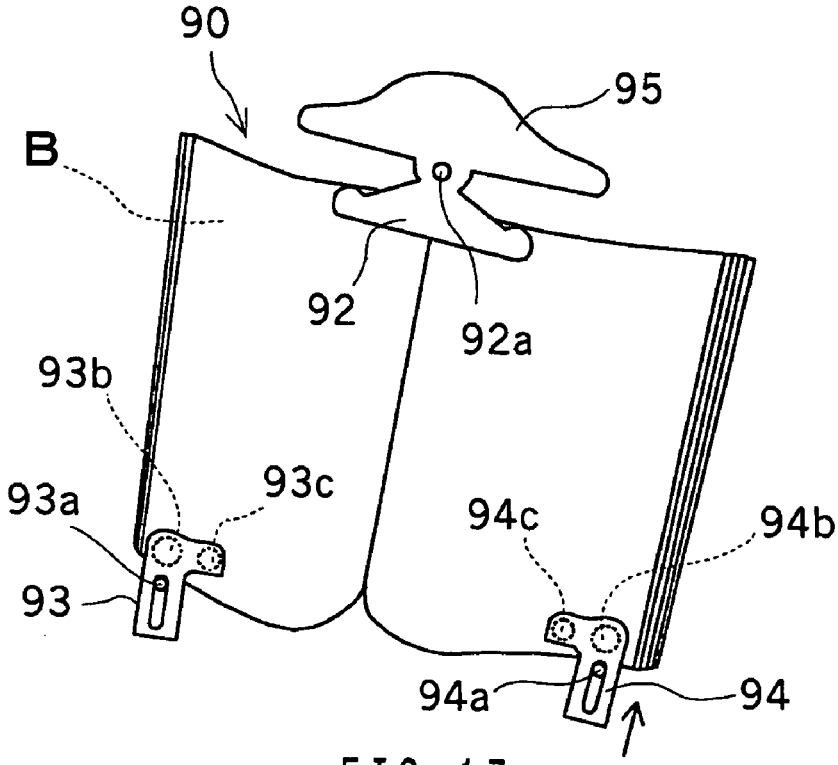
FIGS. 17 and 18 are oblique perspective views to describe a series of page turning motion by the inventive apparatus as a fifth embodiment.
Figure 18:
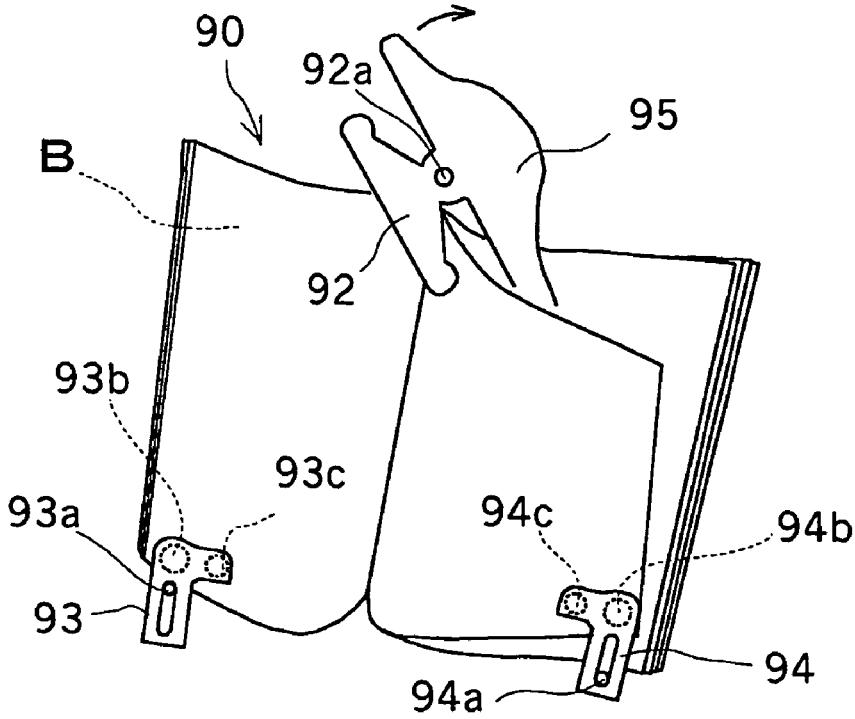

FIGS. 17 and 18 show a fifth embodiment comprising page-turning-up devices which vertically move.

As shown in FIG. 17, an inventive apparatus 90 comprises a page-holding device 92, page-turning-up devices 93, 94 and page-turning-over device 95. The page-turning-up devices 93, 94 are provided on the lower side of the book B. An elongate hole is provided on the page-turning-up devices 93, 94 respectively. The page-tuning-up devices 93, 94 vertically move in a length direction of the elongate hole. The page-pressing device 92 and page-turning-over device 95 move around the pivot 92*a* and have substantially the same configuration that the first embodiment has.

Pivots 93*a*, 94*a* are fixed just below the open book B. The pivots 93*a*, 94*a* are engaged in the elongate holes of the page-turning-up devices 93, 94. The vertical length of the elongate hole controls the moving distance of the page turning-up devices 93, 94. Return springs (not shown in the figure) to pull down the page-turning-up devices 93, 94 are provided on the lower sides of the pivots 93*a*, 94*a*.

Mats 93*b*, 94*b* and mats 93*c*, 94*c* made of urethane or the like are fixed on the upper sides of the page-turning-up devices 93, 94. The mats 93*c*, 94*c* press the lower sides of the page surfaces according to the horizontal width of the open book. When a normal sized book is set, the outer mats 93*b*, 94*b* contact the page surfaces, and when a small-sized book such as a paperback book or the like is set, the inner mats 93*c*, 94*c* contact the page surface. FIG. 17 shows that the mats 93*b*, 94*b* contacting the lower side of the page surface.

In FIG. 17, when the page is turned over from right to left, the page-turning-up device 94 moves in a direction as indicated by an arrow. Then, as shown in FIG. 18, the mat 94*b* creates an upward shearing force on the page surface, the upper side of the page surface is turned up, and then a clearance is created between the first page and second page. Finally, the edge of the page-turning-over device 95 slips into the clearance so that the right page is turned over to the left side.

In the fifth embodiment, the shearing force is vertically given to the page surface, and an open clearance is created behind the page to be turned up. Therefore, the page-turning-over device 95 easily slips into the back of the page. Also, the curve of the page is comparatively small, and a crease will not be easily created on the paper even if the page is repeatedly turned over while reading.

Figure 19:
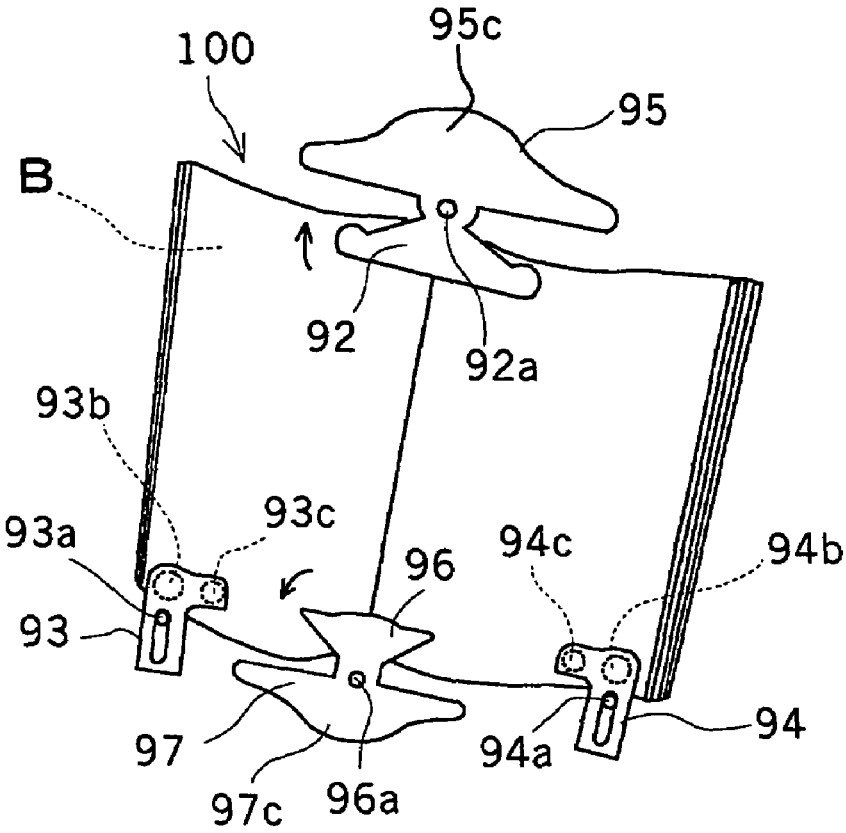
FIG. 19 is an oblique perspective view of a sixth embodiment in use.

FIG. 19 shows a sixth embodiment in which a page-pressing device is provided on the upper and lower sides of the open book.

As shown in FIG. 19 referring to the inventive apparatus 100, page-pressing devices 92, 96 are respectively provided on the upper side and lower side of the midsection between the right and left pages. The page-pressing devices 92, 96 rotatably move around pivots 92*a*, 96*a*. The page-pressing device 92 and the page-turning-over device 95 are formed as a unit around a pivot 92*a*. Also, the page-pressing device 96 and the page-turning-over device 97 are formed as a unit around a pivot 96*a*. Page-pressing portions 95*c*, 97*c* are formed respectively on the page-turning-over devices 95, 97. In other words, the sixth embodiment has a configuration that the page-pressing device and page-turning-over device as shown in the first embodiment are vertically and symmetrically placed.

When the right page is turned up by the page-turning-up device 94, the page-pressing devices 92, 96 rotate in a direction opposite to the direction as indicated by arrows in FIG. 19 with the specified time difference, and run off the page surface. And then, the page turning-over devices 95, 97 push and turn over the page already turned up to the left side. On the other hand, when the left page is turned up by the page-turning-up device 93, the page is turned over to the right side based on the same mechanism.

In the sixth embodiment, when the book is set to be open, the midsection over the right and left pages is vertically pressed by the page-pressing devices 92, 96. Also, when turning over the page, the page surface around the midsection is pressed by the page-pressing portions 95*c*, 97*c* of the page-turning-over devices 95, 97. In other words, the sixth embodiment provides a function that the upper and lower parts of the midsection over the right and left pages are always pressed during the page turning motion. Therefore, the right and left pages are always stable and the page turning motion is completely operated for smooth reading.

Figure 20:
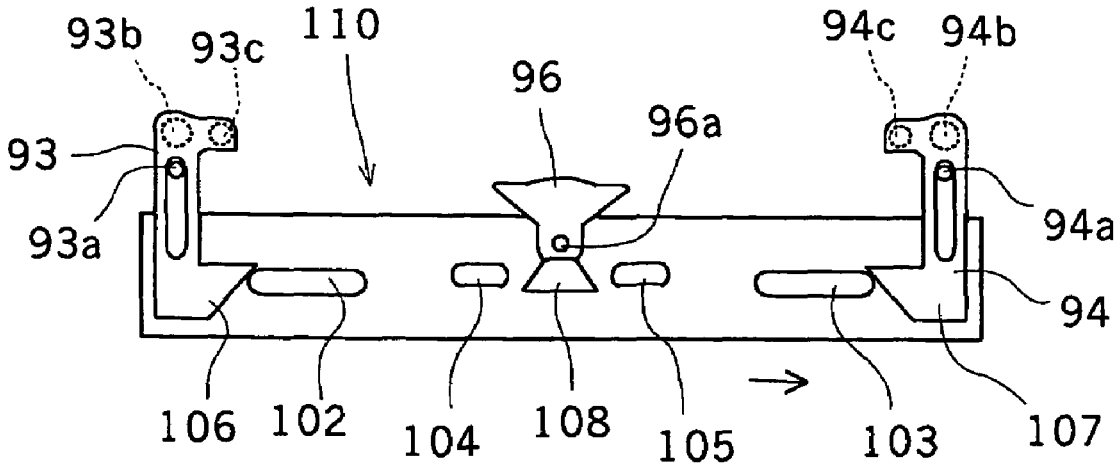
FIGS. 20 to 22 are front views of slide members (interlocking means) of a seventh embodiment and describe a series of interlocking motion and FIG. 23 is a partial perspective view of the inventive apparatus as an eighth embodiment.
Figure 21:
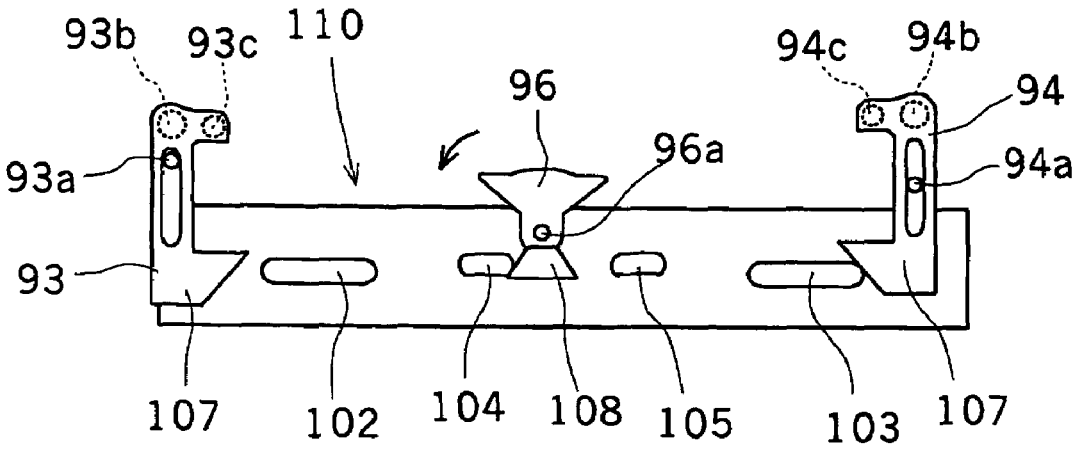
Figure 22:
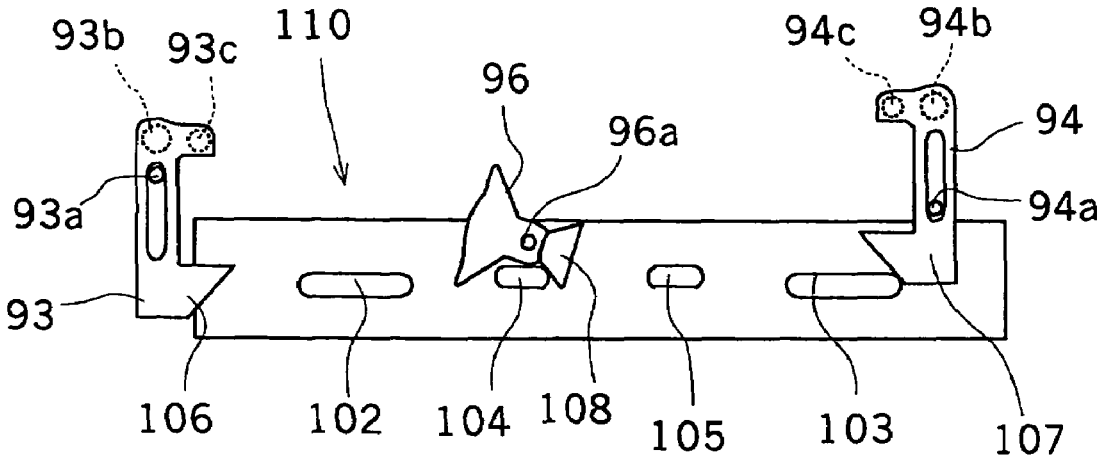

FIGS. 20 to 22 show a seventh embodiment comprising a slide member which interlocks the page pressing device and page-turning-up device with the specified time difference.

As shown in FIG. 20, first locking portions 102, 103 and second locking portions 104, 105 are symmetrically provided on a slide member 110. When the slide member 110 is horizontally moved by the pushing and pulling cable or the like, the first locking portions 102, 103 and the second locking portions 104, 105 also move the same distance.

First receiving portions 106, 107 are formed on the lower edges of the page-turning-up devices 93, 94 respectively. The first receiving portions 106, 107 vertically move together with the page-turning-up devices 93, 94, and comprise inclined planes which are slidably moved to the edge faces of the first locking portions 102, 103 respectively.

A second receiving portion 108 is provided on the other end of the page-pressing device 96 across the pivot 96*a*. The second receiving portion 108 moves together with the page-pressing device 96 around the pivot 96*a*. For convenience of explanation, the page-turning-over device 97 (FIG. 19) which moves together with the page-pressing device 96 is not shown in FIGS. 20 to 22.

The initial position of the slide member 110 is set so that certain distances can be maintained in advance between the first locking portions 102, 103 and the first receiving portions 105, 107 and between the second locking portions 102, 103 and the second receiving portion 108.

When the slide member 110 starts moving in a direction as indicated by an arrow in FIG. 20, firstly the edge face of the first locking portion 103 contacts the inclined plane of the first receiving portion 107 so that the page-turning-up device 94 goes up (FIG. 21), and secondly, when the second receiving portion 108 contacts the second locking portion 104 as shown in FIG. 21, the page-pressing device 96 starts moving in a direction as indicated by an arrow in FIG. 21.

When the slide member 110 moves further to the right, as shown in FIG. 22, the page-turning-up device 94 is lifted higher by the first locking portion 103 and reaches to the highest position.

When the slide member 110 moves from right to left in FIG. 20, the page-turning-up device 93 is lifted while the page-turning-up device 94 remains still, and the page-pressing device 96 rotates in a direction opposite to the direction as indicated by an arrow in FIG. 21.

In the seventh embodiment, when moving the slide member 110 by the specified distance to the right side or left side, the page-pressing device 96 and page-turning-up devices 93, 94 are interlocked keeping the specified time difference according to the timing of the page turning operation. The inventive apparatus can be further reduced in size and weight by utilizing the slide member 110, page-pressing device 96, page-turning-up devices 93 and 94.

Figure 23:
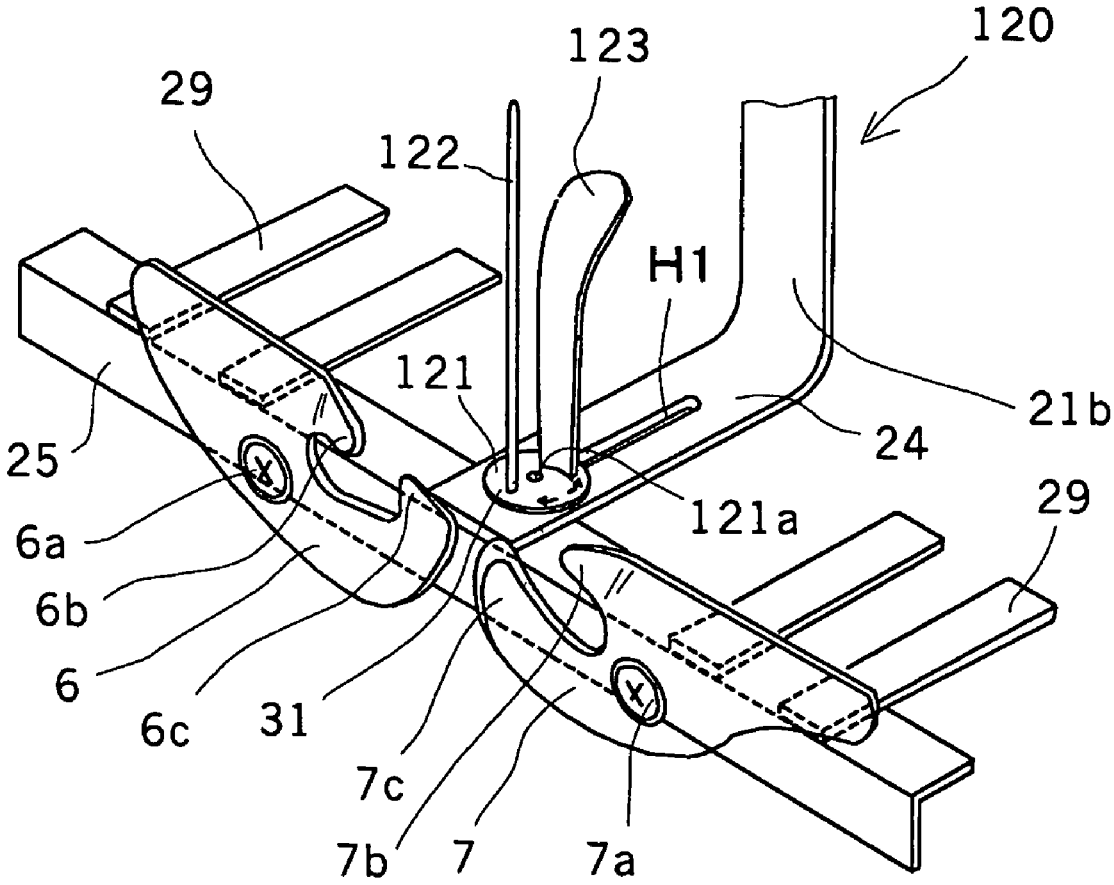

FIG. 23 shows an eighth embodiment comprising a rotatable centerline supporting pin.

As shown in FIG. 23, a centerline supporting pin 122 and a back supporting plate 123 are vertically fixed on a rotor plate 121. Other configurations are substantially the same as those of the first embodiment.

To properly set a book on an inventive apparatus 120, the book is placed on the apparatus such that the right and left stacks of pages are equally balanced and the midsection of the book is placed in between the centerline supporting pin 122 and the back supporting plate 123. At this time, the open pages of the book face the centerline supporting pin 122 and the spine of the book faces the back supporting plate 123 so that the centerline of the open book can be held and supported in a space between the centerline supporting pin 122 and the back supporting plate 123.

When there is a difference in thickness of the right and left pages, the rotor plate 121 moves around the pivot 121*a* so that the spine of the book slants to equalize the height of right and left papers. As for the centerline supporting pin 122, other flexible materials like wires, cords, plastic bars or the like can be used instead of pin material. Elastic wire rod like rubber or the like can also be used since such material will not easily damage the page surface. Besides, it is possible to modify the centerline supporting pin 122 such that it can move back and forth. Furthermore, it is preferable to provide the return spring so that the centerline supporting pin 122 can return to the original position.

Although eight different embodiments are described above, other embodiments including various changes, modifications and alterations from the teachings of the present invention may be contemplated. For example, the shapes of the page-pressing device, page-turning-up device, page-turning-over device, supplementary page-pressing device or the like are not limited to the scope of this invention if the similar functions are incorporated.

The arrangement of the page-pressing device, page-turning-up device, page-turning-over device and supplementary page-pressing device on the book supporting body can be turned upside down.

A rack pinion system to activate the page-pressing device, page-turning-up device, page-turning-over device and supplementary page-pressing device is disclosed as an example for the driving means.

The aforementioned embodiments 1 to 8 have a common configuration that the page-pressing device and page-turning-over device rotate together. However, those devices can be modified to work separately.

Furthermore, the aforementioned embodiments 1 to 8 have another common configuration that the page-pressing device, page-turning-up device and supplementary page-pressing device press the edges (page margins) of the right and left pages. However, if those devices are made of transparent materials, those devices can be placed at any part of the page surface. Also, if the center point of the open book is pressed by such transparent page-pressing device, the book will be greatly supported.

Examples of books to be set on the inventive apparatus include, but not limited to, paperback books, magazines, comic books, photo books or the like.

Also the inventive apparatus can be used for music stand or the like. For example, if the cable system is changed to another type of cable systems such as a foot-operated cable system, pages of musical score or the like will be able to be turned over without using hands.

INDUSTRIAL APPLICABILITY

As described above, the apparatus in this invention produces the following significant effect.

(a) Pages can be properly turned over with one-touch simple operation which produces a comfortable environment for the person who spends time on reading.

(b) It is possible for the person to turn over the pages while standing, sitting or lying in a comfortable position and read for a long time without undue fatigue.

(c) It is useful especially for the disabled since they do not need to hold the book.

(d) The inventive apparatus can be manufactured by a combination of simple components and can also be mechanically simplified and downsized.

The invention claimed is:

1. An apparatus having page turning capability for reading assistance, comprising:

a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, wherein the page pressing means and page turning over means rotatably move together between right and left sides of the book when pressing pages and turning pages over, with each of the page pressing means and page turning means having a longitudinal axis and each of the page pressing means and page turning means being symmetrical about the longitudinal axis, wherein each of the page pressing means and page turning over means has opposing end portions, with each opposing end portion having a bend portion, which presses upward with a certain angle of inclination so as to incline toward the front and run up and over a page surface during page pressing and page turning over.

2. Apparatus having page turning capability for reading assistance of claim 1, comprising a motor drive means instead of the aforementioned remote handling means.

3. An apparatus having page turning capability for reading assistance, comprising:

a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, wherein the page pressing means and page turning over means rotatably move together between right and left sides of the book when pressing pages and turning pages over, with each of the page pressing means and page turning means having a longitudinal axis and each of the page pressing means and page turning means being symmetrical about the longitudinal axis, wherein each of the page pressing means and page turning over means has opposing end portions, with each opposing end portion having a bend portion, which presses upward with a certain angle of inclination so as to incline toward the front and run up and over a page surface during page pressing and page turning over, and also wherein a page-pressing portion (page-pressing surface) to press the second page surface after the first page has been turned over, is provided on the aforementioned page-turning-over means.

4. Apparatus having page turning capability for reading assistance of claim 3, comprising a motor drive means instead of the aforementioned remote handling means.

5. An apparatus having page turning capability for reading assistance, comprising a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a centerline supporting means to support a binding portion of the book wherein a centerline supporting pin to support the open book and a back supporting plate to support the centerline of the book from behind are provided such that the centerline supporting pin and the back supporting plate rotate together holding and supporting the centerline of the book, and also a rotor plate to slant the spine of the book and keep balance according to the height of the page stacks is provided.

6. Apparatus having page turning capability for reading assistance of claim 5, comprising a motor drive means instead of the aforementioned remote handling means.

7. An apparatus having page turning capability for reading assistance, comprising a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a pressing means to press and support the stacks of the right and left pages from behind the book, in which the aforementioned page-stack pressing means is a tilting type with a seesaw mechanism, the seesaw mechanism having a central axis whereby the seesaw mechanism slants depending on a thickness of stacks of right and left pages of the book so as to keep the surface of the right and left pages well-balanced over the seesaw mechanism.

8. Apparatus having page turning capability for reading assistance of claim 7, comprising a motor drive means instead of the aforementioned remote handling means.

9. An apparatus having page turning capability for reading assistance, comprising a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, wherein the page pressing means and page turning over means rotatably move together between right and left sides of the book when pressing pages and turning pages over, with each of the page pressing means and page turning means having a longitudinal axis and each of the page pressing means and page turning means being symmetrical about the longitudinal axis, wherein each of the page pressing means and page turning over means has opposing end portions, with each opposing end portion having a bend portion, which presses upward with a certain angle of inclination so as to incline toward the front and run up and over a page surface during page pressing and page turning over, and also wherein the aforementioned remote handling means is a pushing and pulling cable in which an inner cable slidably moves inside an outer cable, and the aforementioned interlocking means is activated with the inner cable motion by pushing and pulling operation.

10. An apparatus having page turning capability for reading assistance, comprising:

a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a centerline supporting means to support a binding portion of the book wherein flexible centerline supporting materials to support the open book and a back supporting plate to support the centerline of the book from behind are provided such that the flexible centerline supporting materials and the back supporting plate rotate together holding and supporting the centerline of the book, and also a rotor plate to slant the spine of the book and keep balance according to the height of the page stacks is provided.

11. An apparatus having page turning capability for reading assistance of claim 10, comprising a motor drive means instead of the aforementioned remote handling means.

12. An apparatus having page turning capability for reading assistance, comprising a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a centerline supporting means to support a binding portion of the book wherein a centerline supporting pin to support the open book and a back supporting plate to support the centerline of the book from behind are provided such that the centerline supporting pin and the back supporting plate rotate together holding and supporting the centerline of the book, and also a rotor plate to slant the spine of the book and keep balance according to the height of the page stacks is provided, and also characterized in that the aforementioned remote handling means is a pushing and pulling cable in which an inner cable slidably moves inside an outer cable, and the aforementioned interlocking means is activated with the inner cable motion by pushing and pulling operation.

13. An apparatus having page turning capability for reading assistance, comprising a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a pressing means to press and support the stacks of the right and left pages from behind the book, in which the aforementioned page-stack pressing means is a tilting type with a seesaw mechanism, the seesaw mechanism having a central axis whereby the seesaw mechanism slants depending on a thickness of stacks of right and left pages of the book so as to keep the surface of the right and left pages well-balanced over the seesaw mechanism, and also characterized in that the aforementioned remote handling means is a pushing and pulling cable in which an inner cable slidably moves inside an outer cable, and the aforementioned interlocking means is activated with the inner cable motion by pushing and pulling operation.

14. An apparatus having page turning capability for reading assistance, comprising:

a supporting means to support a two-page spread book, a page-pressing means to hold the midsection over the right and left pages of the book, a page-turning-up means to turn up a page by creating a shearing force on the page surface, a page-turning-over means to move into the back side of the page and subsequently turn over the page, an interlocking means to interlock said page-pressing means, page-turning-up means, and page-turning-over means at the specified time, and a remote handling means to relay the moving force to said interlocking means, characterized by comprising a centerline supporting means to support a binding portion of the book wherein flexible centerline supporting materials to support the open book and a back supporting plate to support the centerline of the book from behind are provided such that the flexible centerline supporting materials and the back supporting plate rotate together holding and supporting the centerline of the book, and also a rotor plate to slant the spine of the book and keep balance according to the height of the page stacks provided, and also characterized in that the aforementioned remote handling means is a pushing and pulling cable in which an inner cable slidably moves inside an outer cable, and the aforementioned interlocking means is activated with the inner cable motion by pushing and pulling operation.

* * * * *